US012765618B2

(12) United States Patent
Farrell et al.

(10) Patent No.: US 12,765,618 B2
(45) Date of Patent: Oct. 20, 2026

(54) HEATED APPAREL SYSTEM COMPRISING AT LEAST ONE ARTICLE OF HEATED APPAREL WITH A HEATER, A HEATER CONTROLLER AND AN ELECTRICAL POWER SUPPLY

(71) Applicant: Human Systems Integration, Inc., Walpole, MA (US)

(72) Inventors: Brian Farrell, Walpole, MA (US); Richard Streeter, Walpole, MA (US); Allan Neville, Walpole, MA (US); David McDonald, Walpole, MA (US); Sean Farrell, Walpole, MA (US); John Phillips, Walpole, MA (US)

( * ) Notice: Subject to any disclaimer, the term of this patent is extended or adjusted under 35 U.S.C. 154(b) by 1137 days.

(21) Appl. No.: 17/614,857

(22) PCT Filed: May 27, 2020

(86) PCT No.: PCT/US2020/034731
§ 371 (c)(1),
(2) Date: Nov. 29, 2021

(87) PCT Pub. No.: WO2020/243189
PCT Pub. Date: Dec. 3, 2020

(65) Prior Publication Data

US 2022/0225696 A1 Jul. 21, 2022

Related U.S. Application Data

(60) Provisional application No. 62/853,076, filed on May 27, 2019.

(51) Int. Cl.
*A41D 13/005* (2006.01)

(52) U.S. Cl.
CPC ..... *A41D 13/0051* (2013.01)

(58) Field of Classification Search
CPC ..... H05B 2203/014; H05B 2203/02; H05B 2203/036; H05B 1/0272; H05B 3/345;
(Continued)

(56) References Cited

U.S. PATENT DOCUMENTS 4,404,460 A 9/1983 Kerr
4,705,935 A 11/1987 Traffanstedt et al.
(Continued)

FOREIGN PATENT DOCUMENTS

WO WO 2008/153786 12/2008
WO WO 2017/013493 1/2017
(Continued)

OTHER PUBLICATIONS

Volt Heat, https://voltheat.com/, 2012.
Ororo, https://www.ororowear.com/, 2015.
Gerbing, https://www.gerbing.com/, 2013.

*Primary Examiner* — Topaz L. Elliott
*Assistant Examiner* — Daniel Ward Hatten
(74) *Attorney, Agent, or Firm* — Pandiscio & Pandiscio

(57) ABSTRACT

Disclosed embodiments describe approaches for warming a portion of a human body. The warming is based on heated apparel (e.g., a heated glove) coupled to an electrical power supply through a heater controller. The heated apparel (e.g., a glove) can be fabricated using a narrow knit electronic textile. A heater can be constructed from the narrow knit electronic textile. The heater is coupled to the heated apparel (e.g., a glove) for warming a portion (e.g., a hand) of a human body, wherein heating by the heater is accomplished using electrical power from the electrical power supply. The heater is controlled by a heater controller which is interposed between the heater and the electrical power supply.

43 Claims, 32 Drawing Sheets

(58) Field of Classification Search
CPC ..... H05B 3/347; H05B 3/06; Y02E 60/10; Y02E 60/50; A41D 13/0051
USPC ..... 219/211
See application file for complete search history.

(56) References Cited

U.S. PATENT DOCUMENTS

| | | | | |
|---|---|---|---|---|
| 6,324,053 | B1 * | 11/2001 | Kamijo | G06F 1/163 2/905 |
| 6,784,375 | B2 | 8/2004 | Miyake et al. | |
| D698,522 | S | 2/2014 | Roberts et al. | |
| D698,523 | S | 2/2014 | Roberts et al. | |
| D698,524 | S | 2/2014 | Roberts et al. | |
| D698,525 | S | 2/2014 | Roberts et al. | |
| D698,526 | S | 2/2014 | Roberts et al. | |
| D698,527 | S | 2/2014 | Roberts et al. | |
| D698,528 | S | 2/2014 | Roberts et al. | |
| D703,416 | S | 4/2014 | Roberts et al. | |
| D703,446 | S | 4/2014 | Roberts et al. | |
| D703,922 | S | 5/2014 | Roberts et al. | |
| D704,924 | S | 5/2014 | Roberts et al. | |
| D710,084 | S | 8/2014 | Roberts et al. | |
| D715,029 | S | 10/2014 | Roberts et al. | |
| D715,497 | S | 10/2014 | Roberts et al. | |
| 8,948,839 | B1 | 2/2015 | Longinotti-Buitoni et al. | |
| D731,752 | S | 6/2015 | Roberts et al. | |
| D732,273 | S | 6/2015 | Roberts et al. | |
| D746,550 | S | 1/2016 | Roberts et al. | |
| 9,476,575 | B2 | 10/2016 | Hochman | |
| 9,775,396 | B1 | 10/2017 | Olivares Velasco | |
| 10,201,195 | B1 * | 2/2019 | Khaliuta | H05B 3/34 |
| 10,297,913 | B2 | 5/2019 | Khoury | |
| 10,368,592 | B2 * | 8/2019 | Roh | H05B 3/342 |
| 10,820,437 | B2 | 10/2020 | Aleksov et al. | |
| 10,934,016 | B2 | 3/2021 | Schmidt | |
| 2008/0083720 | A1 | 4/2008 | Gentile et al. | |
| 2008/0287769 | A1 | 11/2008 | Kurzweil et al. | |
| 2011/0108538 | A1 | 5/2011 | Gray et al. | |
| 2011/0260556 | A1 | 10/2011 | Partridge et al. | |
| 2012/0180184 | A1 | 7/2012 | Crye | |
| 2013/0119255 | A1 | 5/2013 | Dickinson et al. | |
| 2014/0070957 | A1 | 3/2014 | Longinotti-Buitoni et al. | |
| 2014/0200487 | A1 | 7/2014 | Ramdas et al. | |
| 2014/0263264 | A1 * | 9/2014 | Weir | H05B 1/0272 219/211 |
| 2014/0318699 | A1 | 10/2014 | Longinotti-Buitoni et al. | |
| 2015/0083705 | A1 | 3/2015 | Cronn et al. | |
| 2015/0122791 | A1 | 5/2015 | Hung et al. | |
| 2015/0136753 | A1 | 5/2015 | Cronn et al. | |
| 2015/0230524 | A1 | 8/2015 | Stevens et al. | |
| 2015/0313519 | A1 | 11/2015 | McKenna | |
| 2015/0366504 | A1 | 12/2015 | Connor | |
| 2016/0038083 | A1 | 2/2016 | Ding et al. | |
| 2016/0095369 | A1 | 4/2016 | Roberts et al. | |
| 2016/0135251 | A1 | 5/2016 | Hopwood et al. | |
| 2016/0198776 | A1 | 7/2016 | Stevens et al. | |
| 2016/0349829 | A1 | 12/2016 | Spiel et al. | |
| 2017/0230916 | A1 | 8/2017 | Stein et al. | |
| 2017/0325337 | A1 | 11/2017 | Karagozler et al. | |
| 2017/0329365 | A1 | 11/2017 | Wong et al. | |
| 2017/0332442 | A1 | 11/2017 | Strecker | |
| 2018/0103694 | A1 | 4/2018 | Fortenbacher | |
| 2018/0184735 | A1 | 7/2018 | Longinotti-Buitoni et al. | |
| 2019/0058242 | A1 | 2/2019 | Tabe | |
| 2019/0125262 | A1 | 5/2019 | Markel | |
| 2019/0132948 | A1 | 5/2019 | Longinotti-Buitoni et al. | |
| 2019/0208836 | A1 * | 7/2019 | Demers | H05B 3/342 |
| 2019/0373963 | A9 * | 12/2019 | Longinotti-Buitoni | A41D 1/005 |
| 2019/0374376 | A1 | 12/2019 | Khaliuta et al. | |
| 2021/0195732 | A1 * | 6/2021 | Longinotti-Buitoni | H05K 3/361 |
| 2022/0061413 | A1 | 3/2022 | Gasser | |

FOREIGN PATENT DOCUMENTS

| | | |
|---|---|---|
| WO | WO 2017/033058 | 3/2017 |
| WO | WO 2017/221204 | 12/2017 |
| WO | WO 2018/209144 | 11/2018 |

* cited by examiner

Upper Body and Lower Body Controller Switches mounted on front of vest

Controller Switches can be mounted any place on the MOLLE for easy access to change heat settings

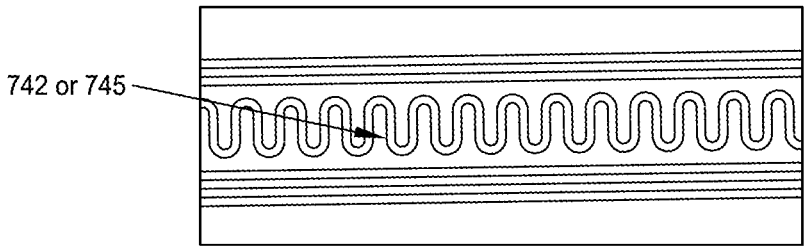

eTextile Power Bus - 2 jacketed small gauge copper wires (20-28 AWG) knitted in a sinewave pattern as part of a narrow knit elastic band

FIG. 17

Here we show the power conducting eTextile as integrated into the combat shirt. Shirt is shown inside out.

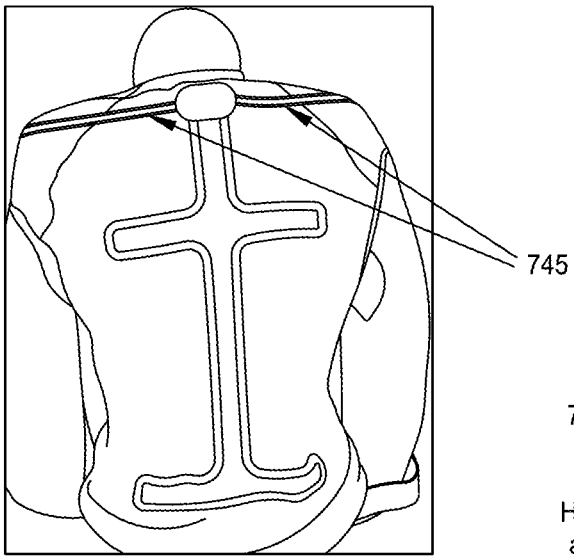

Here is where the etextile power bus branches out from the heater controller connection down each arm to the blove connection

FIG. 18

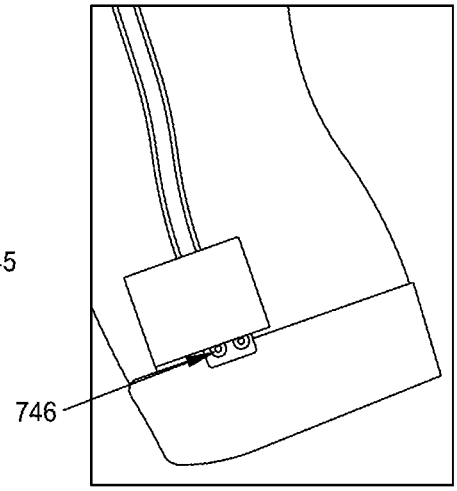

Here is where the etextile power bus terminates at the end of both sleeves to make connection at the glove connection

FIG. 19

Shirt side connector - eTextile Power Bus terminates in two female medical grade snaps Glove side connector - the 2 ends the eTextile heater element terminate in two male medical grade snaps Glove and shirt power bus connectors Inside out heated glove showing the heating element Right side out heated glove Male snaps on glove heater harness Metallic resistive thread or yarn knitted into a narrow elastic band Two heater panels are made, heat pressed and then sewn on the sides of the underwear Snap connection points which electrically connect to the heater panels are created on both sides of the underwear and are part of the connection point from pants through the shirt to the underwear eTextile heater element is installed into a laser cut pathway;

Medical grade snap connector similar to that used in the heated glove, which connects to the power bus integrated into the pants Snap connector termination at the end of the eTextile power bus in combat pants Tunnels created in the pants for routing the eTextile power bus, but these could also be sewn in.

Cable/Connector to connnect to heater controller connection on shirt or pants (or other garment)

This double ended assembly is integrated into the lower hem of the shirt and allows the power bus of the pants to be connected to the heater harness in the underwear through a tucked-in shirt.

The double ended assembly sewn into the shirt

The laser cut harness pattern - the eTextile heater element is integrated into this pieces, which is then heat pressed and sewn into the shirt itself, as shown at right In the inside of the shirt Shirt inside right Cables from controller switch route up over the shoulder shrouded by a fabric tunnel or around the waist inside the cummerbund to minimize snag hazards A 2 prong (using stereo jack connectors) port is integrated into the upper center back of the shirt In the inside of the shirt (back view)

The laser cut harness pattern - the eTextile heater element is integrated into this pieces, which is then heat pressed and sewn into the shirt itself, as shown at right Pouch for integrating pouch for heater controller(s) and battery Pouch integrated on soldier vest with mesh flep flap down Pouch integrated on soldier vest with mesh flap up showing heat controllers A 2 prong (using stereo jack connectors) port is integrated into the upper center back of the pants

HEATED APPAREL SYSTEM COMPRISING AT LEAST ONE ARTICLE OF HEATED APPAREL WITH A HEATER, A HEATER CONTROLLER AND AN ELECTRICAL POWER SUPPLY

REFERENCE TO PENDING PRIOR PATENT APPLICATION

This patent application claims benefit of prior U.S. Provisional Patent Application Ser. No. 62/853,076, filed May 27, 2019 by Human Systems Integration, Inc. and Brian Farrell for HEATED GLOVE COUPLED TO A WEARABLE POWER SYSTEM, which patent application is hereby incorporated herein by reference.

STATEMENT REGARDING FEDERALLY SPONSORED RESEARCH OR DEVELOPMENT

This invention was made with Government support under Contract No. W911QY-21-C-0070 awarded by the U. S. Army Combat Capabilities Development Command. The U.S. Government has certain rights in this invention.

FIELD OF ART

This patent application relates generally to warming, and more particularly to a novel heated apparel system comprising at least one article of heated apparel with a heater, a heater controller and an electrical power supply.

BACKGROUND

People around the world live, work and play in a wide range of environments. The environments can range from the hot, arid conditions of a desert, to the hot, humid conditions of a jungle, to the frosty, low-humidity conditions of high mountains or polar regions. Whatever the environment, proper clothing is typically required for comfort, safety or even survival. The clothing that people choose to wear in their environments is often dictated by culture, local requirements, or fashion. Some cultures dictate rules for what is considered proper attire for women and men, while other cultures maintain a laissez faire attitude. Similarly, light-weight, loose-fitting clothing is most comfortable in the tropics, in contrast to the heavy wool or fleece sweaters and jackets worn in cold climes. And in terms of fashion, while wearing a couture gown and extravagant jewelry, or wearing a black tie and a diamond-accented dress watch, may be highly appropriate for a red carpet or gala affair, such attire would be ludicrous or even dangerous in the Antarctic. People thus choose their clothing to meet these various requirements. In many cases, the clothing choices come down to personal preference, clothing price point, or even individual sense of fun. An otherwise drab or muted outfit can be enlivened by a colorful scarf, a brightly patterned shirt, or a particularly loud tie.

SUMMARY

The present invention comprises the provision and use of a novel heated apparel system for warming one or more portions of a human body. The novel heated apparel system generally comprises at least one article of heated apparel with a heater, a heater controller and an electrical power supply.

The heated apparel may comprise garments such as shirts, sweaters and coats, pants, underwear and socks, and other wearable items such as hats, balaclavas, scarves and neck warmers, gloves and mittens, and shoes and boots. For the purposes of the present invention, all of the foregoing, and the like, are intended to be encompassed by the term "apparel". The heated apparel carries a heater which provides heat when electrical power is supplied to the heater. The heater can include electrically-resistive material (e.g., electrically resistive wire) which generates heat when an electrical current is passed through it. The electrically-resistive material (e.g., electrically resistive wire) can be attached to, or woven or knit into, the heated apparel (e.g., a glove).

The heater controller is interposed between the electrical power supply and the heated apparel. The heater controller comprises control electronics for regulating the electrical power delivered to the heated apparel from the electrical power supply. The heater controller may be carried by a wearable item such as a belt, harness, vest, backpack, waist pack, field bag or pouch or satchel, etc.

The electrical power supply may be in the form of a battery or another source of electrical power, e.g., a power generation system. The electrical power supply may be carried by a wearable item such as a belt, harness, vest, backpack, waist pack, field bag or pouch or satchel, etc. Or the electrical power supply may be provided by a vehicle or aircraft, with the electrical power supply being connected to the heater controller via external cabling.

Thus it will be seen that, with the novel heated apparel system of the present invention, warming of the one or more portions of the human body is enabled by using electrical power provided by the electrical power supply to energize a heater carried by the heated apparel, with the heater controller controlling operation of the heater so that the amount of heating provided by the heater can maintain a desired temperature at the heater. The ability to warm a given body part, such as a hand, while enabling that body part to remain agile, depends on the capabilities of the heater and the availability of the electrical power to energize the heater. The warming of the body part has many applications. The warming can be used to maintain a level of comfort, and/or to protect the body part from a hostile environment, among many other applications.

Significantly, multiple articles of heated apparel may be coupled to a heater controller, e.g., via a "hub and spoke" scheme.

And significantly, multiple articles of heated apparel may be "daisy-chained" to one another so that the power for enabling a remote article of heated apparel is supplied through an intervening article of apparel, which may or may not itself constitute an article of heated apparel. By way of example but not limitation, it may be desired to provide only heated gloves, but a shirt could be used as an intervening article of apparel to deliver power to the gloves, with the power being connected at the neck of the shirt and run down the sleeves of the shirt to the gloves via embedded shirt wiring. So the intervening article of apparel can be for power distribution only, or it can be for a combination of power distribution while itself being heated.

In one preferred form of the invention, there is provided a heated apparel system comprising:

at least one article of heated apparel wearable by a user, the at least one article of heated apparel comprising a heater which provides heat when connected to an electrical power supply, wherein the at least one article of heated apparel does not carry the electrical power supply; and a heater controller wearable by the user, the heater controller being connected to the heater and being connectable to the electrical power supply, the heater controller controlling the electrical power delivered to the heater from the electrical power supply so as to control the heat provided by the heater.

In another preferred form of the invention, there is provided a method for warming a portion of the body of a user, the method comprising:

providing a heated apparel system comprising:

at least one article of heated apparel wearable by a user, the at least one article of heated apparel comprising a heater which provides heat when connected to an electrical power supply; and a heater controller wearable by the user, the heater controller being connected to the heater and to the electrical power supply, the heater controller controlling the electrical power delivered to the heater from the electrical power supply so as to control the heat provided by the heater; and using the heater controller to control the electrical power delivered to the heater so as to warm a portion of the body of the user.

In another preferred form of the invention, there is provided a heated apparel system comprising:

at least one article of heated apparel wearable by a user, the at least one article of heated apparel comprising a heater which provides heat when connected to an electrical power supply; and a heater controller wearable by the user, the heater controller being connected to the heater and being connectable to the electrical power supply, the heater controller controlling the electrical power delivered to the heater from the electrical power supply so as to control the heat provided by the heater;

and further wherein the heater controller is configured to provide a desired constant power level.

In another preferred form of the invention, there is provided a heated apparel system comprising:

at least one article of heated apparel wearable by a user, the at least one article of heated apparel comprising a heater which provides heat when connected to an electrical power supply;

an electrical power supply, wherein the electrical power supply comprises a conformal battery wearable by the user; and a heater controller wearable by the user, the heater controller being connected to the heater and to the electrical power supply, the heater controller controlling the electrical power delivered to the heater from the electrical power supply so as to control the heat provided by the heater.

In another preferred form of the invention, there is provided an article of heated apparel, the article of heated apparel comprising:

a body wearable by a user;

a heater carried by the body, wherein the heater provides heat when connected to an electrical power supply; and a power bus formed integral with the body.

In another preferred form of the invention, there is provided an article of apparel, the article of apparel comprising:

a body wearable by a user; and a power bus formed integral with the body, the power bus being configured to power a heater on a different article of apparel.

In another preferred form of the invention, there is provided a heated apparel system comprising:

a first article of heated apparel, the first article of heated apparel comprising:

a first body wearable by a user;

a first heater carried by the first body, wherein the first heater provides heat when connected to an electrical power supply;

a first power bus formed integral with the first body, the first power bus being connected to the first heater; and an auxiliary power bus formed integral with the first body; and a second article of heated apparel, the second article of heated apparel comprising:

a second body wearable by a user;

a second heater carried by the second body, wherein the second heater provides heat when connected to the electrical power supply; and a second power bus formed integral with the second body, the second power bus being connected to the auxiliary power bus.

In another preferred form of the invention, there is provided a heated apparel system comprising:

a first article of apparel, the first article of apparel comprising:

a first body wearable by a user; and a first power bus formed integral with the first body; and a second article of apparel, the second article of apparel comprising:

a second body wearable by a user;

a heater carried by the second body, wherein the heater provides heat when connected to an electrical power supply; and a second power bus formed integral with the second body, the second power bus being connected to the first power bus.

Various features, aspects, and advantages of various embodiments will become more apparent from the following further description.

BRIEF DESCRIPTION OF THE DRAWINGS

The following detailed description of certain embodiments may be understood by reference to the following figures wherein like numbers refer to like parts, and further wherein:

FIGS. 11-58 are schematic views showing an exemplary heated apparel system comprising multiple articles of heated apparel with heaters, heater controllers and an electrical power supply.

DETAILED DESCRIPTION

The Novel Heated Apparel System in General

Whether working, recreating or on maneuvers in a cold environment, proper clothing is required to provide warmth and comfort. In fact, proper clothing is so critical to such endeavors that the clothing can easily mean the difference between life and death. The deleterious effects of cold on a human body are well known. Principal among these effects are frostbite and hypothermia. Frostbite can cause damage to exposed tissue, and can easily occur in digits, ears, nose, or any exposed skin. The damaged tissue at a digit can cause difficulty in moving a digit, and in extreme cases, frostbite can lead to the loss of the digit or appendage. Hypothermia can result from the body temperature of a person dropping below 95 degrees Fahrenheit (35 degrees Celsius). Hypothermia can present as uncontrollable shivering, tiredness, clumsiness, slurred speech, etc. Serious injury or death can result. A further risk of cold includes problems with the heart. More particularly, the cold can cause the heart to pump harder as the body attempts to increase warming bloodflow to the torso and appendages. The resulting increases in heart rate and blood pressure can cause a heart attack. Clearly, clothing and gear that protects the body is critical in an environment that can kill.

Being cold is a miserable experience. To protect against the cold, people have developed warm garments such as shirts, sweaters and coats, pants, underwear and socks, and other wearable items such as hats, balaclavas, scarves and neck warmers, gloves and mittens, and shoes and boots. For the purposes of the present invention, all of the foregoing, and the like, are intended to be encompassed by the term "apparel". In the past, the basic approach to making apparel warmer was simply to make the apparel heavier and/or to make the apparel out of a more thermally-insulating material. While increased warmth can result, the weight and thickness of the heavier and/or more thermally-insulating material often restricts motion of the arms and legs, and heavy mittens prevent use of the hands beyond simple grasping. In addition, apparel designed to keep one warm while stationary can easily cause profuse sweating when the person is exerting strenuously. Dampness adjacent to skin is particularly dangerous in cold climates because such moisture draws heat away from the very body that the apparel is attempting to keep warm.

Figure 1:
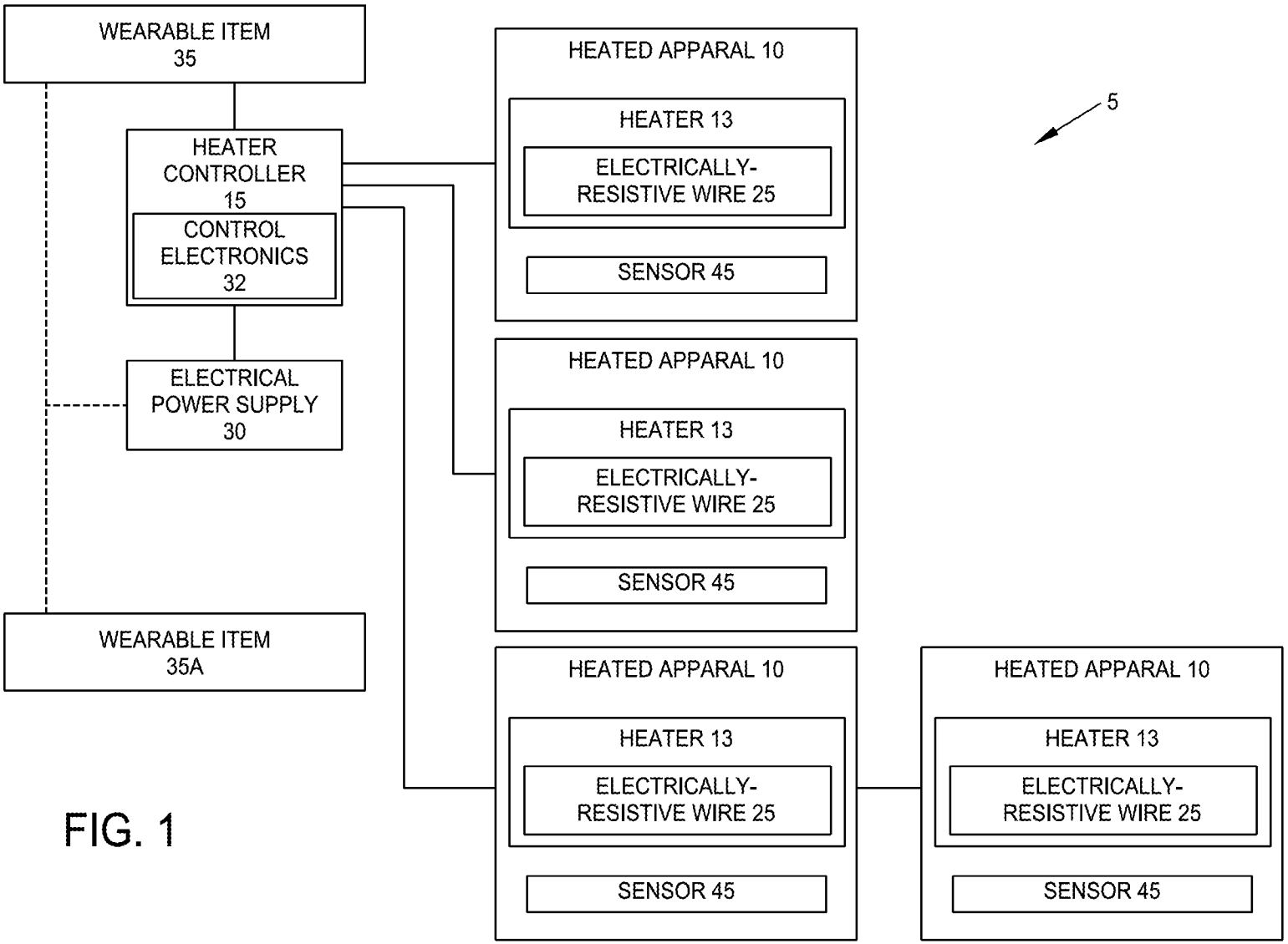
FIG. 1 is a schematic view showing a novel heated apparel system formed in accordance with the present invention.

In order to address the deficiencies associated with prior art apparel, and looking now at FIG. 1, the present invention comprises the provision and use of a novel heated apparel system 5 for warming one or more portions of a human body. The novel heated apparel system 5 generally comprises at least one article of heated apparel 10 with a heater 13, a heater controller 15 and an electrical power supply 30.

The heated apparel 10 may comprise garments such as shirts, sweaters and coats, pants, underwear and socks, and other wearable items such as hats, balaclavas, scarves and neck warmers, gloves and mittens, and shoes and boots. For the purposes of the present invention, all of the foregoing, and the like, are intended to be encompassed by the term "apparel". The heated apparel 10 carries a heater 13 which provides heat when electrical power is supplied to the heater 13. The heater 13 can include electrically-resistive material (e.g., electrically resistive wire 25) which generates heat when an electrical current is passed through the electrically-resistive material. The electrically-resistive material (e.g., electrically resistive wire 25) can be attached to, or knit, woven or embroidered into, or printed or laminated onto, the heated apparel 10 (e.g., a glove). In the case of a printed ink heater, one heater manifestation could be a Positive Temperature Coefficient (PTC) heater which is a self-regulating heater that runs open-loop, without any external controls (i.e., without the need for a heater controller 15).

The heater controller 15 is interposed between the electrical power supply 30 and the heated apparel 10. The heater controller 15 comprises control electronics 32 for regulating the electrical power delivered to the heated apparel 10 from the electrical power supply 30. The heater controller 15 may be carried by a wearable item 35 such as a belt, harness, vest, backpack, waist pack, field bag or pouch or satchel, etc.

The electrical power supply 30 may be in the form of a battery or another source of electrical power, e.g., a power generation system. The electrical power supply 30 may be carried by a wearable item such as a belt, harness, vest, backpack, waist pack, a field bag or pouch or satchel, etc. The electrical power supply 30 may be carried by the same wearable item 35 which carries the heater controller 15, or the electrical power supply 30 may be carried by a different wearable item 35A. Alternatively, if desired, electrical power supply 30 may be provided by a vehicle (e.g. car, truck, aircraft, etc.), with the electrical power supply 30 being connected to the heater controller 15 via external cabling.

Thus it will be seen that, with the novel heated apparel system 5 of the present invention, warming of one or more portions of a human body is enabled by using electrical power provided by the electrical power supply 30 to energize a heater 13 carried by the heated apparel 10, with the heater controller 15 controlling operation of the heater 13 so that the amount of heating provided by the heater 13 can maintain a desired temperature or level of power at the heater 13. The ability to warm a given body part, such as a hand, while enabling that body part to remain agile, depends on the capabilities of the heater 13 and the availability of the electrical power to energize the heater 13. The warming of the body part has many applications. The warming can be used to maintain a level of comfort, and/or to protect the body part from a hostile environment, among many other applications.

If desired, heated apparel 10 can comprise one or more sensors 45 for providing information regarding the heating being provided by heated apparel 10. In this form of the invention, sensors 45 are connected to heater controller 15 so that heater controller 15 can take into account the information provided by sensors 45 while controlling the operation of heater 13.

Significantly, multiple articles of heated apparel 10 may be coupled to a heater controller 15, e.g., via a "hub and spoke" scheme.

And significantly, multiple articles of heated apparel 10 may be "daisy-chained" to one another so that the power for enabling a remote article of heated apparel 10 is supplied through an intervening article of apparel, which may or may not itself constitute an article of heated apparel 10. By way of example but not limitation, it may be desired to provide only heated gloves, but a shirt could be used as an intervening article of apparel to deliver power to the gloves, with the power being connected at the neck of the shirt and run down the sleeves of the shirt to the gloves via embedded shirt wiring. So the intervening article of apparel can be for power distribution only, or it can be for a combination of power distribution while itself being heated.

Further details regarding the heated apparel system 5, its constituent components heated apparel 10, heater controller 15 and electrical power supply 30, and their operation, will hereinafter be disclosed.

Flow Diagram for a Heated Apparel System Comprising at Least One Article of Heated Apparel with a Heater, a Heater Controller and an Electrical Power Supply As noted above, people wear a variety of types, sizes, shapes, and colors of apparel such as shirts, sweaters and coats, pants, underwear and socks, and other wearable items such as hats, balaclavas, scarves and neck warmers, gloves and mittens, and shoes and boots. The particular apparel that a person wears may be dictated by local custom, may be chosen to communicate or convey messages to other people, or may be required based on climate, profession, and so on. In cold or dangerous climates, for example, the apparel that a person wears can be chosen to provide protection against hostile environmental elements. The apparel is donned to keep wind and precipitation away from the body, while at the same time maintaining body heat and dry comfort. Anyone familiar with outdoor activities is aware that a person who becomes overheated and damp from exercising runs a significant risk of hypothermia or frostbite when the activity abates. To allay this problem, fabrics have been developed that purport to keep exterior moisture out while wicking internal moisture away from the body.

There is a significant challenge in choosing the "right" apparel. Putting on more and more layers of clothing can indeed assist in retaining body heat, but as additional layers are added, the person wearing the apparel can lose flexibility of limbs, dexterity of fingers, and so on. This loss of flexibility and dexterity can range from a mere inconvenience to an inability to perform critical tasks. The critical tasks can include operating oil rigs in the North Sea or in the Arctic, missions of military personnel in cold or wet environments, etc.

To enable the apparel to remain light-weight and warm, novel approaches are disclosed herein for warming one or more portions of a human body. These novel approaches comprise the provision and use of the novel heated apparel system 5. The novel heated apparel system 5 generally comprises at least one article of heated apparel 10 with a heater 13, a heater controller 15 and an electrical power supply 30. The heated apparel 10 may comprise garments such as shirts, sweaters and coats, pants, underwear and socks, and other wearable items such as hats, balaclavas, scarves and neck warmers, gloves and mittens, and shoes and boots. For the purposes of the present invention, all of the foregoing, and the like, are intended to be encompassed by the term "apparel". The heated apparel 10 carries a heater 13 which provides heat when electrical power is supplied to the heater 13. The heater 13 can include electrically-resistive material (e.g., electrically-resistive wire 25) which generates heat when an electrical current is passed through the electrically-resistive material. The electrically-resistive material (e.g., electrically-resistive wire 25) can be attached to, or embroidered, knit or woven into, or printed or laminated onto, the heated apparel 10 (e.g., a glove). The heater controller 15 is interposed between the electrical power supply 30 and the heated apparel 10. The heater controller 15 comprises control electronics 32 for regulating the electrical power delivered to the heated apparel 10 from the electrical power supply 30. The heater controller 15 may be carried by a wearable item 35 such as a belt, harness, vest, backpack, waist pack, field bag or pouch or satchel, etc. The electrical power supply 30 may be in the form of a battery or another source of electrical power, e.g., a power generation system. The electrical power supply 30 may be carried by a wearable item such as a belt, harness, vest, backpack, waist pack, field bag or pouch or satchel, etc. The electrical power supply 30 may be carried by the same wearable item 35 which carries the heater controller 15, or the electrical power supply 30 may be carried by a different wearable item 35A. Alternatively, if desired, electrical power supply 30 may be provided by a vehicle (e.g., car, truck, aircraft, etc.), with the electrical power supply 30 being connected to the heater controller 15 via external cabling. Or vehicle or aircraft power may be used to charge the electrical power supply 30, e.g., where it constitutes a battery.

Figure 1A:
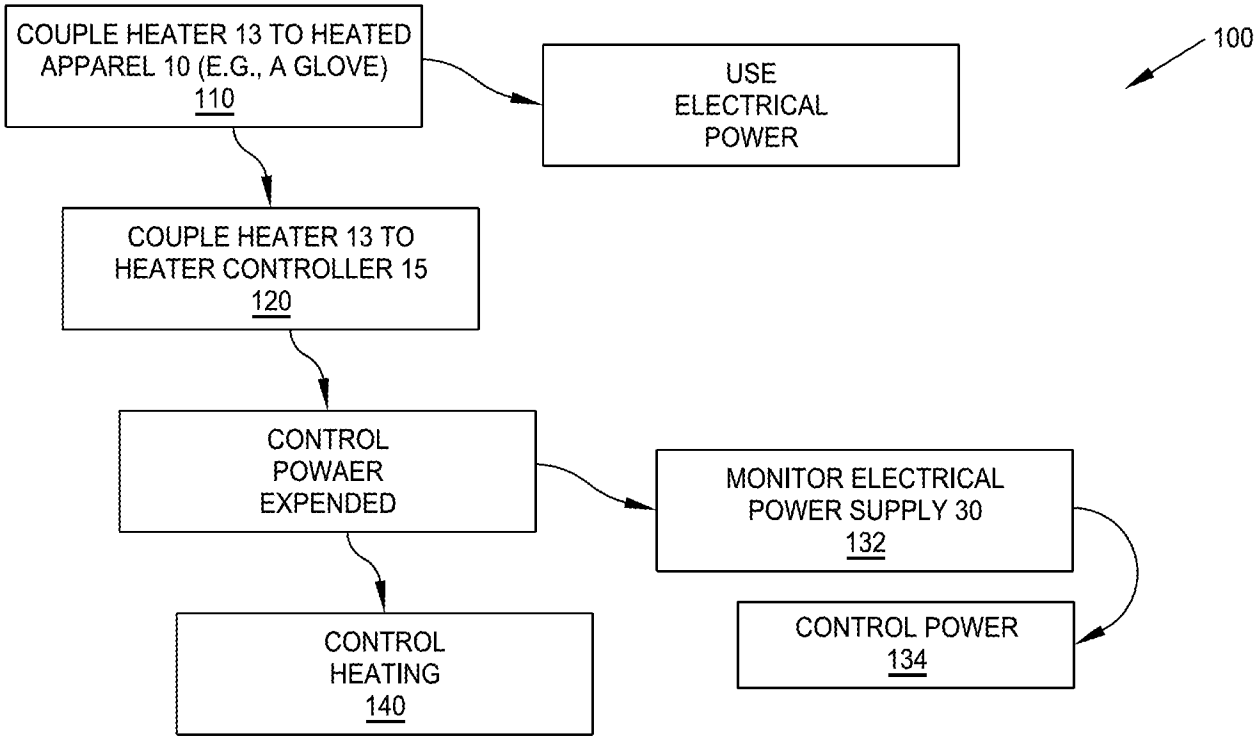
FIG. 1A is a flow diagram for heated apparel (e.g., a glove) coupled to a heater controller and an electrical power supply (e.g., a battery)

FIG. 1A is a flow diagram for heated apparel system 5. The flow 100 includes the step 110 of coupling a heater 13 to heated apparel 10 (e.g., a glove) for heating a portion (e.g., a hand) of a human body. The heater 13 can be coupled to an interior or exterior surface of the heated apparel 10 (e.g., a glove) using an adhesive, a hook-and-eye retainment fastener, a strap, etc., or the heater 13 can be more permanently embedded into the heated apparel 10 via sewing, knitting or lamination. In general, it is preferred that heater 13 constitute a permanent part of the apparel item. The heater 13 can be inserted into a pouch or pocket of the heated apparel 10 (e.g., a glove). In embodiments, the heater 13 comprises electrically-resistive material (e.g., electrically-resistive wire 25). The electrically-resistive material can include a cord, thread, or filament. The electrically-resistive material (e.g., electrically-resistive wire 25) can be embroidered, knit or woven into the fabric or material from which the heated apparel (e.g., a glove) is made. The electrically-resistive material that comprises the heater 13 can be embroidered, knit or woven into the material of the heated apparel (e.g., a glove) using an origami technique.

Heating by the heater 13 is accomplished using electrical power 112 provided by electrical power supply 30. The electrical power supplied by electrical power supply 30 can include DC power, AC power, pulsed power, and the like. The power can be based on constant voltage, constant current, etc. The electrical power supply 30 can include a power pack, a battery pack (comprising one or more batteries), etc. The electrical power supply 30 can include a power generation system, where the power generation system can be based on movement of the body, solar energy, a fuel cell, etc.

The flow 100 includes the step 120 of coupling the heater 13 to a heater controller 15 worn on the human body. The heater controller 15 can be carried by, or included in, a wearable item 35, e.g., a belt, harness, garment, item of equipment, etc. In embodiments, the heater controller 15 can be carried by or included in a vest. The vest can include a general purpose vest such as an ordinary clothing vest, or a specialty item such as a military vest or flak jacket. In other embodiments, the heater controller 15 can be carried by or included in a backpack. The backpack can include a general purpose backpack such as a backpack for hiking, camping, or climbing, a specialty backpack such as a military equipment pack, etc. In other embodiments, the heater controller 15 can be carried by or included in a field bag or pouch or satchel.

The flow 100 further includes the step 130 of controlling power expended by the heater 13. The step 130 of controlling power expended by the heater 13 can include limiting the voltage or current supplied to the heater 13 so as to protect the heater 13, optimizing the power expended by the heater 13 so as to maximize battery life, and so on. In embodiments, the step 130 of controlling power expended by the heater 13 can be based on the "health" of the electrical power supply 30. The "health" of the electrical power supply 30 can include a measurement or estimate of energy remaining within the electrical power supply 30, the operating temperature of the electrical power supply 30, etc.

The flow 100 further includes the step 132 of monitoring the electrical power supply 30. As described herein, the step 132 of monitoring the electrical power supply 30 can include measuring voltage, current, or temperature; keeping track of the numbers of hours of usage of the electrical power supply 30, etc. In a usage example, certain types of batteries can be safely discharged in a particular manner in order to avoid damage to the exhausted or nearly-exhausted battery cells. The electrical power supply 30 can include a conformable/wearable battery.

In embodiments, the flow 100 includes the step 134 of controlling the power expended by the heater 13 based upon the monitoring of the electrical power supply 30 (which occurs in the aforementioned step 132). Controlling the power expended by the heater 13 can include protecting the heater 13 from over-voltage or under-voltage events, over-current events, and the like. Other embodiments of controlling the power expended by the heater 13 can include controlling the power expended on the heaters 13 of additional articles of heated apparel 10, various electronic devices, etc. In a usage example, military personnel can carry and use a range of electronic devices, where each device consumes power. The electronic devices can include lighting such as one or more colors of LED lighting, a GPS unit, one or more radios such as land, mobile or team radios, a personnel beacon, night vision equipment, etc. Overall power consumption can be balanced, prioritized, minimized, etc. Power consumption can be reduced by dimming or extinguishing lighting, reducing the transmit power of radios or using a different communication mode, reducing the heating temperature or the timing of the one or more heaters, and so on. Priority can be given to devices such as night vision equipment at night, or to a personnel beacon during a rescue.

The flow 100 further includes the step 140 of controlling heating by the heater 13. Various parameters of the heater 13 can be controlled. The step 140 of controlling heating by the heater 13 can include controlling an operating temperature of the heater 13, a quantity of joules of heat delivered by the heater 13, etc. In embodiments, the heating can be based on a temperature measurement on the body (e.g., a hand in the case where the heated apparel 10 comprises a glove). The temperature measurement on the body (e.g., a hand) can be accomplished using a thermistor, an infrared (IR) sensor, etc. (which may be the aforementioned sensor 45). The temperature measurement on the body (e.g., a hand) can be used to increase an amount of heat delivered by the heater 13, to reduce an amount of heat delivered by the heater 13, to maintain a given amount of heat delivered by the heater 13, etc. In other embodiments, the step 140 of controlling heating can be based on a temperature measurement on an outside surface of the heated apparel 10 (e.g., a glove). The temperature measurement on the outside of the heated apparel 10 (e.g., a glove) can be measured using a temperature-sensing component, where the temperature that is measured can be used to calculate or estimate a temperature on the body (e.g., a hand), to calculate a delta or differential temperature between the body (e.g., a hand) and the outside surface of the heated apparel 10 (e.g., a glove), etc. The step 140 of controlling heating by the heater 13 can also be based on an amount of time. In embodiments, the heating can be based on required heating duration. The required heating duration can include a day, overnight, the duration of a task or of a mission, etc. In other embodiments, the heating can be further based on the power available from the electrical power supply 30. The amount of heating can be reduced, the duration of the heating can be scheduled for a period of time, etc. In certain usage situations or requirements, the electrical power supply 30 can be used by one or more devices in addition to the heater 13 carried by the heated apparel 10. These other devices can include lighting, communications equipment, GPSs, etc. A priority can be determined and assigned to the usage of the devices and the heater 13. A priority can include favoring communications over light, heat over GPS, or other combinations of devices and usage needs or preferences.

Various steps in the flow 100 shown in FIG. 1A may be changed in order, repeated, omitted, or the like without departing from the disclosed concepts. Various embodiments of the flow 100 can be included in a computer program product embodied in a non-transitory computer readable medium that includes code executable by one or more processors.

Glove with Resistive Wiring

Figure 2B:
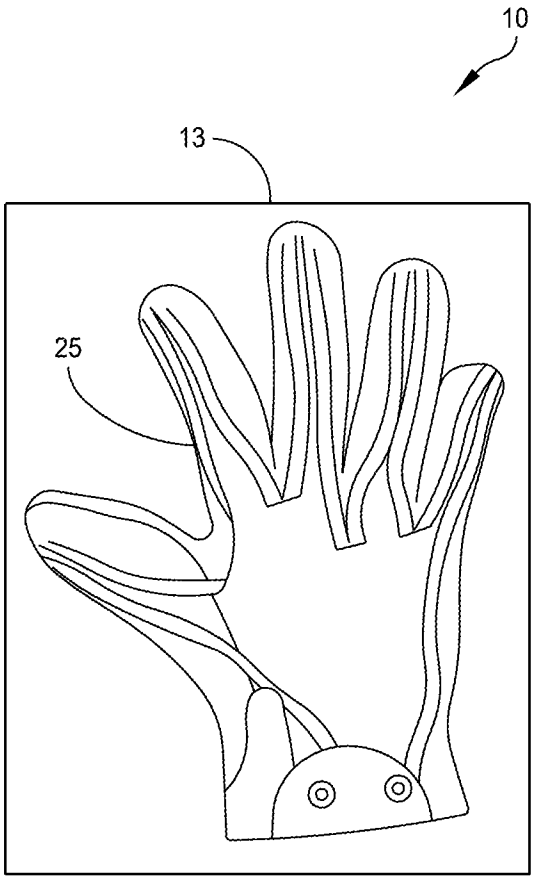
FIGS. 2A and 2B show a glove with resistive wiring.
Figure 2A:
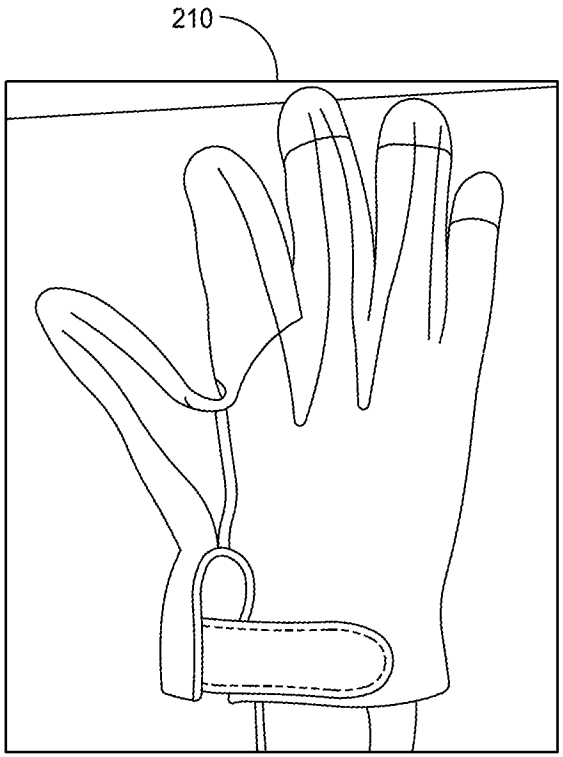

FIGS. 2A and 2B show an example of heated apparel 10, in this case a glove 210 with a heater 13. Heater 13 can include electrically-resistive wiring 25, where the electrically-resistive wiring can be used to provide heat when a current is passed through the electrically-resistive wiring. The electrically-resistive wiring 25 of the heater 13 is coupled to a heater controller 15 worn on the human body.

Glove 210 can include a dress glove, a work glove, a protective glove, a military glove, etc. In embodiments, the glove can include a mitten, mitt, or other wearable item that can be applied to the hand. Heater 13 can be based on an electrically-resistive material, where the electrically-resistive material can include a resistive wire, a resistive thread, resistive film, etc. By way of example but not limitation, electrically-resistive wire 25 can be applied to the glove 210. The electrically-resistive wire 25 can be coupled to the inside of the glove 210, to the outside of the glove 210, or to both the inside and the outside of the glove 210. The electrically-resistive wire 25 can be coupled to the glove 210 so that the digits of the hand can receive heat from the heater 13. The heater 13 can be laid out in a variety of patterns, designs, etc., where the patterns or designs can be chosen to maximize heat transfer, minimize reduction in dexterity, etc. In embodiments, the electrically-resistive wire 25 can be laid out in an origami pattern. The glove 210 can comprise insulation layers to distribute the heat created by the heater 13. The glove 210 can also comprise a protective layer for durability, especially when the glove is used in hazardous or abrasive work environments.

In embodiments, a glove 210 uses a narrow knit "electronic textile" for the heater 13. The narrow knit "electronic textile" is incorporated into a cut-and-sew manufacturing process. The narrow knit electronic textile can comprise a stainless steel heating fiber (i.e., the electrically-resistive material) coupled to a stretchable fabric. Other electrically-resistive materials can be used such as silver-coated nylon, nitinol, nichrome, etc. In some embodiments, 2D glove pattern pieces are generated individually and then assembled together so as to together form the complete glove. In embodiments, a printed heater (e.g., resistive ink) is applied to the 2D glove pattern pieces. In other embodiments, a 3D knitting process is performed where the glove, with integral heating wires or threads, is knit as a unit.

In embodiments, the heater controller 15 for powering glove 210 using electrical power supply 30 comprises control electronics 32 which are electrically connected to glove 210, e.g., with a power conduit. In embodiments, a peripheral device that is integrated into a larger system leverages some core functions (central power, central electronics) in that system. In embodiments, a base layer garment, with an integral electronic textile power bus, can be used to provide power from a remote location (e.g., a hip, the base of the neck, the back, etc.) to the gloves. The remote location usage can help remove battery bulk from the hands or arms. In other words, the electrical power supply 30, which is located remote from glove 210, is connected to the heater controller 15, and the heater controller 15 is in turn connected to the glove 210 by a power conduit. In some embodiments, the power conduit may be "free-standing" (e.g., a free-standing power cable). In other embodiments, the power conduit extending from heater controller 15 to glove 210 may be integrated into a garment which is worn on the body, with the heater controller 15 being connected to glove 210 via the power conduit which is integrated into the intervening garment. Note that the intervening garment may or may not comprise heated apparel.

The heating provided by glove 210 aids in control of local tissue blood flow (i.e., blood perfusion) within the body.

It should be appreciated that the foregoing discussion regarding gloves 210 can also apply to other heated apparel.

Glove Coupled to Heater Controller

Figure 3:
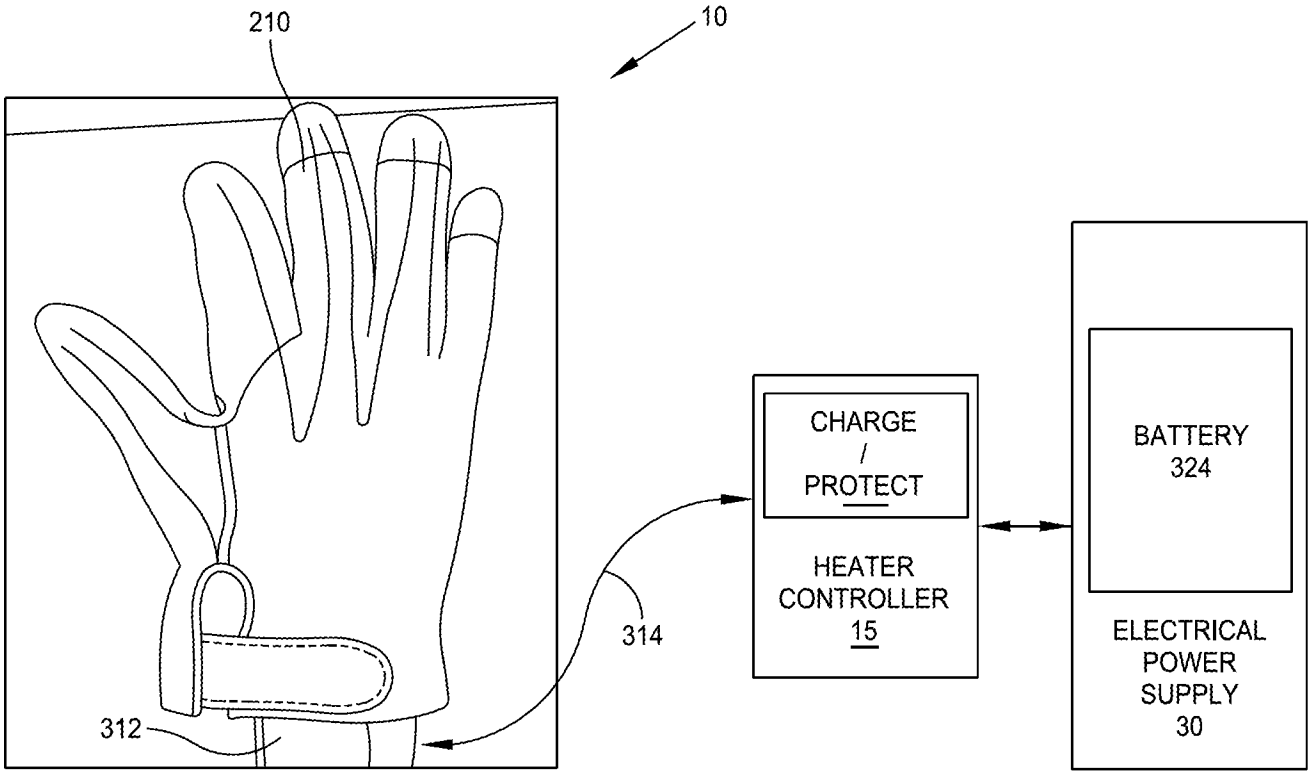
FIG. 3 shows a glove coupled to a heater controller and an electrical power supply.

FIG. 3 shows an example of heated apparel 10, in this case a glove 210, coupled to a heater controller 15. Heater controller 15 is in turn coupled to the electrical power supply 30. The heater controller 15 can be carried by, or included in, a wearable item 35, e.g., a belt, harness, vest, part of a backpack, part of a waist pack, part of a field bag or pouch or satchel, etc. The electrical power supply 30 can be carried by, or included in, the same wearable item 35 or a different wearable item (e.g., the aforementioned wearable item 35A). The heater controller 15 can enable heated apparel 10 (e.g., glove 210) which is coupled to the heater controller 15. The heater 13, such as an electrically-resistive wire 25, can be coupled to glove 210 for warming the hand of a human body. The heating by the heater 13 can be accomplished using electrical power from the electrical power supply 30 (e.g., a battery connected to heater controller 15). The heater 13 is coupled to heater controller 15 worn on the human body. In FIG. 3, glove 210 is shown coupled to heater controller 15, and heater controller 15 is shown connected to electrical power supply 30. The glove 210 can include a dress glove or a fashion glove, a work or specialty glove, a military glove, etc. The glove 210 can include a connection point 312. The connection point 312 can include a connector, contacts, a coupling, a jack, etc. A connection 314 can be made between glove 210 and heater controller 15. The connection 314 can include a cable, a multi-conductor wire, a wiring harness, etc. In embodiments, the connection 314 can include snaps, magnetic couplings, etc., and can couple to a device, a garment, etc., without needing an additional fastener. The heater controller 15 can include one or more of management components, etc. In embodiments, the heater controller 15 includes a charge and protect component 322. The charge and protect component 322 can be used to control voltage and current to charge electrical power supply 30, to protect electrical power supply 30 from over-voltage or current, over-temperature conditions, etc. The electrical power supply 30 can include a battery 324. In embodiments, the electrical power supply 30 can include a plurality of batteries 324. The batteries 324 can include sealed lead acid (SLA) batteries, lithium ion batteries, nickel metal hydride batteries, lithium iron phosphate (LiFePO4) batteries, etc.

It should also be appreciated that the foregoing discussion regarding gloves 210 can also apply to other heated apparel.

Power and Data Management Hub

Figure 4:
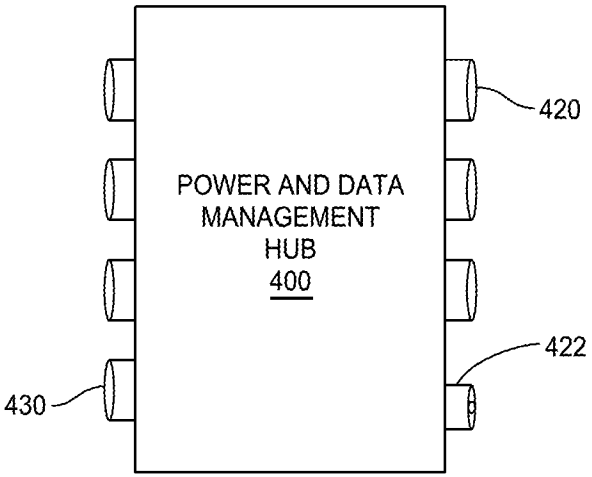
FIG. 4 illustrates a power and data management hub.

FIG. 4 illustrates a power and data management hub 400 which may be incorporated in the heated apparel system 5. Power and data management hub 400 can be used to couple a heater 13 of an article of heated apparel 10 (e.g., a glove 210), an electrical power supply 30, and a variety of devices (e.g., lighting, a GPS system, radio, personnel beacons, night vision equipment, etc.) to the heater controller 15. In other words, the power and data management hub 400 can serve as a hub between the heater controller 15 and the electrical power supply 30, the heater 13 on the heated apparel 10 (e.g., a glove 210), and other devices (e.g., lighting, a GPS system, radio, personnel beacons, night vision equipment, etc.). The power and data management hub 400 can be used by heater controller 15 to monitor power availability, power usage, operating characteristics and data operating parameters of the electrical power supply 30, the heater 13 in heated apparel 10, and the other devices (e.g., lighting, a GPS system, radio, personnel beacons, night vision equipment, etc.). Power and data management hub 400 enables the operation of heated apparel 10 (e.g., a glove 210) coupled to a heater controller 15, where the heated apparel 10 comprises a heater 13 coupled to the heated apparel 10 (e.g., a glove 210) for heating a portion (e.g., a hand) of a human body, where heating by the heater 13 is accomplished using electrical power supplied by the electrical power supply 30 worn on the human body. The power and data management hub 400 can be coupled between heater controller 15, electrical power supply 30, one or more heaters 13 of heated apparel 10, and other devices, etc. As noted above, these other devices can include lighting, communications equipment, GPS, electronic devices such as smartphones or tablets, etc. The power and data management hub 400 can be coupled to the heater controller 15, electrical power supply 30, heater 13 of the heated apparel 10, and such other devices through connectors, e.g., the connectors 420 shown in FIG. 4. A connector 420 can comprise a standard 3.5 mm tip-ring-sleeve (TRS) or tip-ring-ring-sleeve (TRRS) connector, a 13 mm (¼") TRS cable, a military specification (mil-spec) connector such as a MIL-DTL-38999 connector, a magnetic or snap connector, etc. An exposed connector 422 is shown in FIG.

4. Unused connectors can be protected by a protective sleeve, cap, cover, etc., such as the cap 430 shown mounted to connector 420 in FIG. 4.

Block Diagram for a Heated Apparel and Power Usage Scheme

Figure 5:
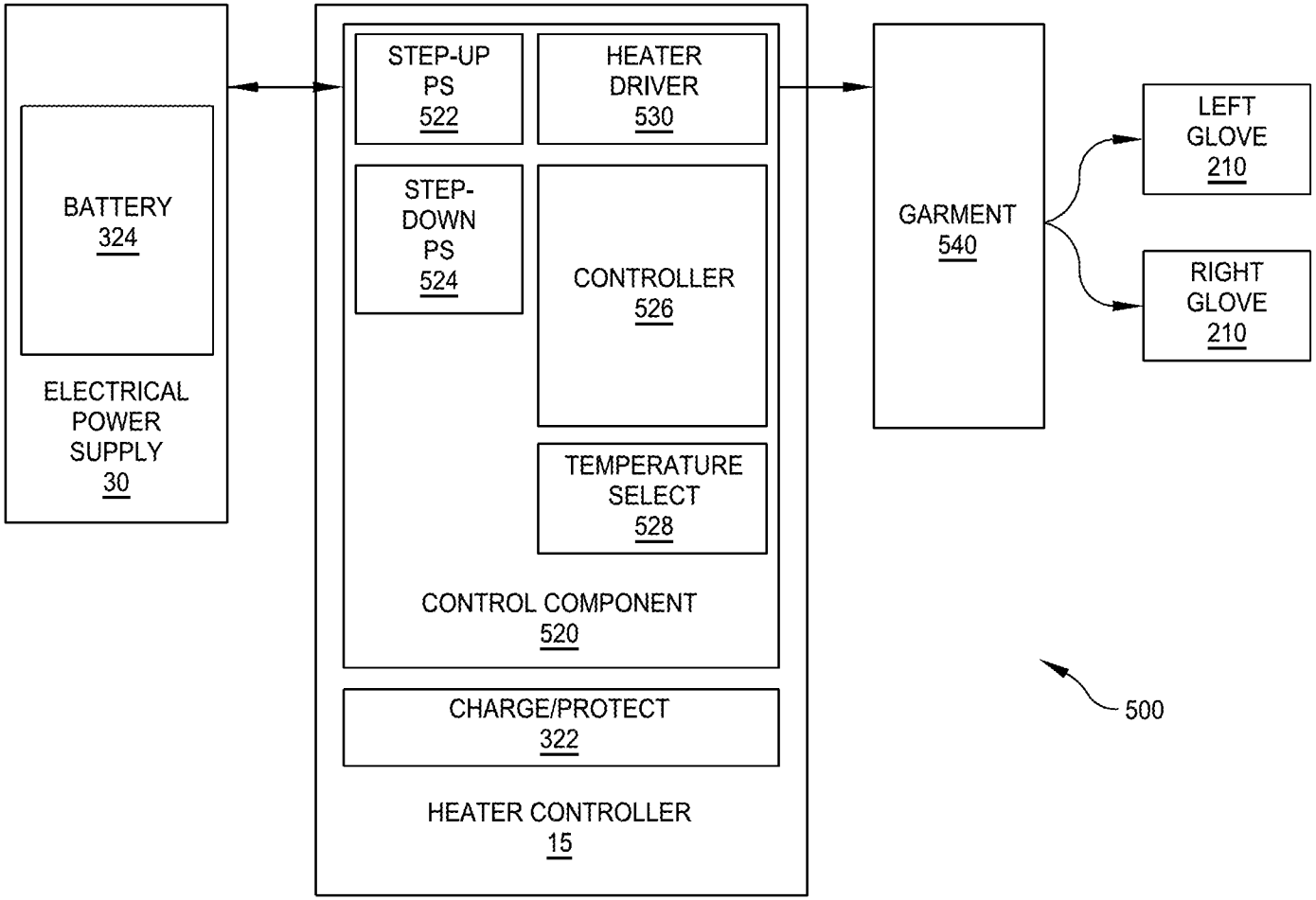
FIG. 5 is a block diagram for a heated apparel (e.g., a glove) and power usage scheme.

FIG. 5 is a block diagram for a heated apparel and power usage scheme. As discussed herein, a heater 13 coupled to heated apparel 10 (e.g., a glove 210) can provide heating to a portion (e.g., a hand) of the body covered by the heated apparel 10 (e.g., the glove 210). In order to efficiently and effectively provide heating to the body (e.g., a hand), power coupled to the heater 13 can be managed and controlled by a heater controller 15 so as to provide appropriate amounts of heat, to maintain comfort of the anatomy (e.g., a hand), etc. FIG. 5 shows a heated apparel and power usage scheme 500 which supports heated apparel 10 (e.g., a glove 210) coupled to a heater controller 15. By way of example, a heater 13 is coupled to a glove 210 for warming the hand of a human body, where heating by the heater 13 is accomplished using electrical power. This electrical power is provided to the heater 13 by coupling the heater 13 of the glove 210 to a heater controller 15 worn on the human body, with heater controller 15 being connected to the electrical power supply 30. Heated apparel and power usage scheme 500 controls the power provided to the heater 13 of the glove 210 from electrical power supply 30.

With heated apparel and power usage scheme 500, a heater controller 15 is used to provide power to a heater 13 coupled to heated apparel 10 (e.g., a glove 210), and to power control and management components. Power management can include regulating power settings to heated apparel 10 (e.g., gloves 210) and, in some embodiments, can comprise a DC to DC converter. In some embodiments, an analog control (e.g., a potentiometer) is used to control output voltage going to the heated apparel 10 (e.g., gloves 210) and thereby control heating power. A feedback loop can be employed with a control unit that is automatically adjusted. The heater controller 15 can include the charge and protection component 322. The charge and protection component 322 can be used to charge electrical power supply 30 (e.g., which may comprise one or more batteries 324), where charging the one or more batteries 324 can include controlling the voltage, current, or both voltage and current, supplied to the batteries 324.

A control component 520 can be included in the heater controller 15. The control component 520 can be used to control or charge the electrical power supply 30, to power and manage one or more heaters 13 of heated apparel 10, or to power and manage one or more devices (e.g., lighting, communications equipment, GPS, electronic devices such as smartphones or tablets, etc.), etc. The control component 520 can include a step-up power supply 522. The step-up power supply 522 can be used to convert the voltage obtained from the electrical power supply 30 to a higher voltage where the higher voltage can be used to power one or more heaters 13 of heated apparel 10. In embodiments, the step-up power supply 522 can be used to step up the voltage from the electrical power supply 30, e.g., up to 22-24 VDC. The control component 520 can include a step-down power supply 524. The step-down power supply 524 can be used to convert the voltage obtained from the electrical power supply 30 to a lower voltage. The lower voltage can be used to power one or more digital or other electronic components. In embodiments, the step-down power supply 524 can be used to step down the voltage from the electrical power supply 30, e.g., down to 3.3 VDC. The control component 520 can include a controller 526. The controller 526 can include a microcontroller, where the microcontroller can execute software code. The software code can be executed to control the heater controller 15, e.g., to charge the electrical power supply 30, control one or more heaters 13 (on heated apparel 10), or control a device (e.g., lighting, communications equipment, GPS, electronic devices such as smartphones or tablets, etc.), etc.

The control component 520 can include a temperature select component 528. The temperature select component 528 can be user-operated and can be used by the user to select a temperature comfort zone, a specific temperature in Celsius or Fahrenheit, a temperature range such as "high", "medium", or "low", and so on. The temperature select component 528 can provide data to the controller 526. The control component 520 can include a heater driver 530. The heater driver 530 can provide a voltage, a current, a frequency, etc., that can be used to energize/control one or more heaters 13 carried by heated apparel 10. A garment 540 (such as long underwear, a shirt or jacket) can be coupled to the control component 520. Garment 540 (which may or may not include a heater 13 for heating the body) receives power from heater driver 530. Garment 540 can include electrical connections and conductors which can be used to provide power from the control component 520 to a downstream heated apparel, e.g., a left glove 210 or a right glove 210, a left sock or a right sock (not shown), etc. Thus it will be seen that control component 520 can be used to supply power to a "first stage" article of apparel (e.g., garment 540), and/or to a "second stage" article of heated apparel 10 (e.g., a left glove 210, a right glove 210, etc.) by means of the intervening "first stage" article of apparel (e.g., garment 540). Note that the "first stage" article of apparel may or may not be an article of heated apparel.

Block Diagram for Heated Apparel Control

Figure 6:
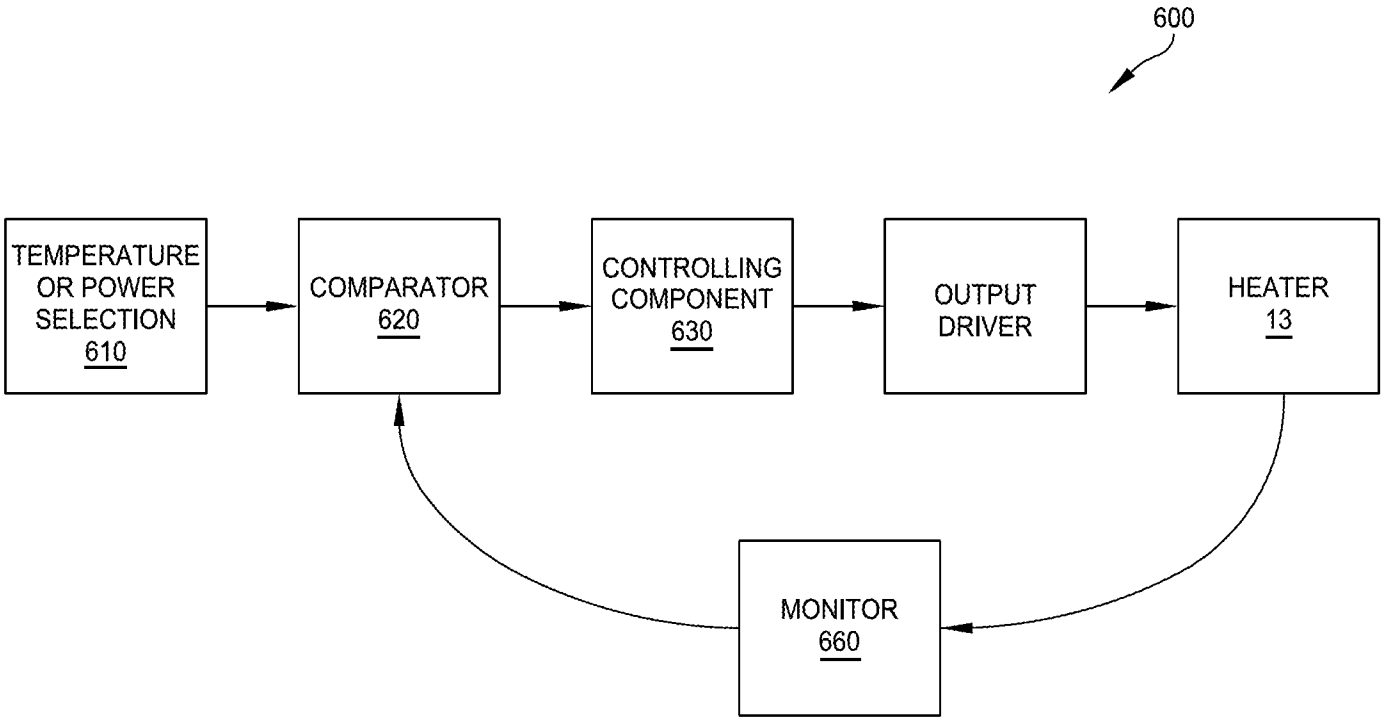
FIG. 6 is a block diagram for heated apparel (e.g., a glove) control.

FIG. 6 is a block diagram for heated apparel control. As discussed above, a heater 13 coupled to heated apparel 10 can be used to provide heat to a portion of a human body. The heater 13 can be coupled to various forms of apparel, e.g., a shirt, a sweater or a coat, pants, underwear and socks, or other wearable items such as a hat, a balaclava, a scarf or a neck warmer, gloves and mittens, and shoes and boots. Heated apparel 10 (e.g., a heated glove 210) coupled to an electrical power supply 30 via a heater controller 15 can be controlled so as to provide an appropriate amount of heat for a portion (e.g., a hand) of a human body. A heater 13 is coupled to the heated apparel 10 (e.g., a glove 210) for heating a portion (e.g., a hand) of a human body, where heating by the heater 13 is accomplished using electrical power from electrical power supply 30. The heater 13 is coupled to a heater controller 15 worn on the human body, and heater controller 15 is coupled to electrical power supply 30, so that the heater controller 15 regulates the electrical power delivered to the heated apparel 10.

Heated apparel control 600 may be used to regulate the heat provided by heated apparel 10. Heated apparel control 600 includes temperature or power level selection 610. Selecting a temperature or power level can include selecting a specific temperature or power level, selecting a range of temperatures or power levels, selecting a high or low temperature or power level cutoff, selecting a range of temperatures or power levels such as high, medium, or low, etc. Temperature or power level selection 610 can be accomplished using buttons, a knob, a slider, a touch screen, etc.

Heated apparel control 600 can include a comparator 620. The comparator 620 can be used to compare the temperature that was selected to an actual temperature as measured by a sensor (e.g., sensor 45 on heated apparel 10). The actual temperature can include a heater temperature, a temperature on the human hand, etc. Heated apparel control 600 can include a controlling component 630. The controlling component 630 can include a microcontroller, where the microcontroller can be coded or programmed to operate the heater 13 coupled to the heated apparel 10 (e.g., a glove 210). Heated apparel control 600 can include an output driver 640. The output driver 640 can be used to provide a voltage, a current, a frequency, etc. to the heater 13. The heater 13 can be coupled to the heated apparel 10 (e.g., a shirt, a sweater or a coat, pants, underwear and socks, or other wearable items such as a hat, a balaclava, a scarf or a neck warmer, gloves and mittens, and shoes and boots). The heater 13 can provide heat based on the voltage, current, etc., provided to the heater 13 by the output driver 640. Heated apparel control 600 can include a monitor 660. The monitor 660 can be used to observe operating or other characteristics, such as operating temperature of the heater 13, temperature of a portion of the user's body (e.g., a hand), accuracy of a voltage, current, or frequency from the output driver 640, etc. Note that monitor 660 may communicate with sensor 45 on heated apparel 10. The monitor 660 can be coupled to the comparator 620. By providing feedback data from the heater 13 via the monitor 660 to the comparator 620, heated apparel control can be accomplished.

Example: Heated Gloves Coupled to a Heater Controller

Figure 7:
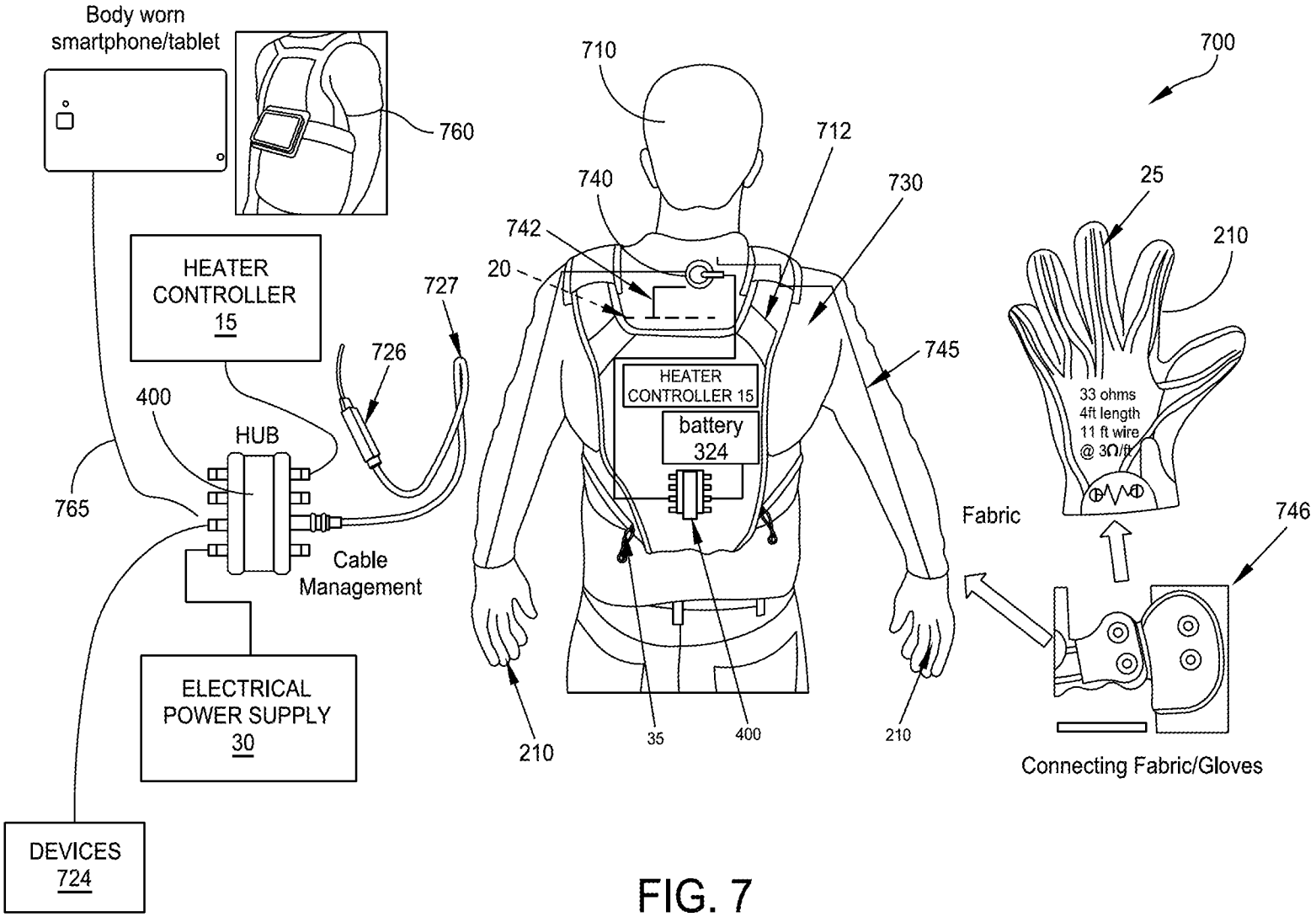
FIG. 7 shows heated gloves coupled to a heater controller and an electrical power supply.

FIG. 7 shows heated gloves 210 coupled to a heater controller 15 which is in turn coupled to an electrical power supply 30. The heater controller 15 can be carried by or included in the aforementioned wearable item 35, e.g., a vest, a backpack, a waist pack, a field bag or pouch or satchel, etc. so that it can be worn by a person. The heater controller 15 can provide power (supplied by electrical power supply 30) to a heater 13 carried by heated apparel 10 (e.g., the heated glove 210), where the heater 13 comprises an electrically resistive material (e.g., electrically resistive wire 25).

More particularly, heated gloves 210, a heater controller 15 and an electrical power supply 30 are shown at 700 in FIG. 7. A person 710 can put on a wearable item 35, e.g., a vest 712 as shown, a backpack (not shown), or other wearable item, e.g., a waist pack, a field bag or pouch or satchel, etc. This wearable item 35, e.g., vest 712, can include pockets, straps, snaps, or other fasteners for carrying components that enable heating via the one or more heated gloves 210. As discussed above, a power and data management hub 400 can be used to enable couplings (e.g., via cabling) between electrical power supply 30 (e.g., a battery 324), heater controller 15, heaters 13 in heated apparel 10, electronic devices 724 (e.g., lighting, a GPS system, radio, personnel beacons, night vision equipment, etc.), etc. These couplings can be accomplished using a variety of cable management techniques. The electrical power supply 30 can include a conformable/wearable battery 324. The conformable/wearable battery 324 can include a power source that conforms to the shape of a vest or backpack, to the shape of a person wearing the battery, etc. User controls 726 may be connected (e.g., by cabling 727) to power and data management hub 400 so as to enable the user to control the operation of the heater controller 15. The heater controller 15, the power and data management hub 400, the conformable/wearable battery 324, etc., can be mechanically coupled to the wearable item 35, e.g., a vest 712 (shown) or a backpack (not shown). The heater controller 15 can be connected to an article of heated apparel 10 (e.g., a heated shirt 730) via a connector 740. This heated apparel 10 (e.g., the heated shirt 730) comprises an electrically conductive bus 742 which carries power to heaters 13 carried by the heated shirt 730, and also comprises an electrically conductive bus 745 which delivers power to heaters 13 carried by other heated apparel 10 (e.g., gloves 210) worn by the user. It should be appreciated the electrically conductive bus 742 essentially comprises a 2-conductor bus (one conductor for current delivery and one conductor for current return). The electrically conductive bus 742 can be attached to, embroidered, knit or woven into, or printed or laminated onto, the apparel. And it should be appreciated the electrically conductive bus 745 essentially comprises a 2-conductor bus (one conductor for current delivery and one conductor for current return). The electrically conductive bus 745 can be attached to, embroidered, knit or woven into, or printed or laminated onto, the apparel. In embodiments, these electrically conductive buses 745 connect to connectors 746 at the cuff of a shirt in order to deliver power to heated gloves 210. Heated gloves 210 can be coupled to the shirt via snap connectors 746. In embodiments, the heated gloves 210 connect mechanically and electrically to the electrically conductive buses 745 of the wearable item 35 (e.g., the heated shirt 730) via snaps. In embodiments, a processor, such as a smartphone or tablet 760, can control the power or heating of the heated apparel 10 (e.g., gloves 210). In embodiments, a cable 765 connects the processor (e.g., smartphone or tablet 760) to the heater controller 15 through power and data management hub 400.

In FIG. 7, gloves 210 are shown connected to heater controller 15 via an intervening article of heated apparel 10, i.e., the heated shirt 730. However, it should be appreciated that, if desired, the intervening article of apparel need not be an article of heated apparel 10, i.e., it could be an article of apparel which does not carry a heater 13, provided, however, that the intervening article of apparel carries the connector 740 and electrically conductive buses 745 needed to deliver power to the downstream article of heated apparel (e.g., heated gloves 210).

Figure 8:
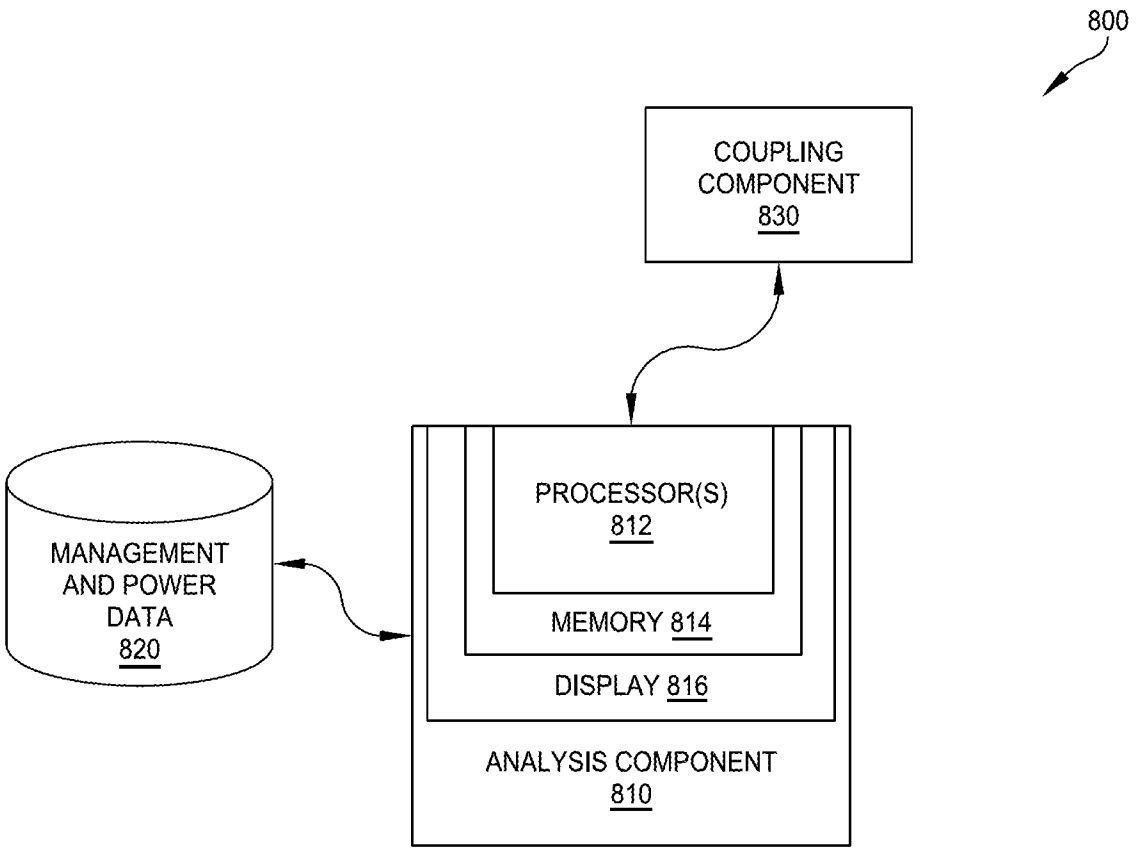
FIG. 8 is a control system for heated apparel (e.g., a glove) coupled to a heater controller.

Programmable Control System for Heated Apparel Coupled to a Heater Controller FIG. 8 is a diagram showing a programmable control system 800 for heated apparel 10 (e.g., a glove 210). Programmable control system 800 is incorporated in the heater controller 15. Heating of a portion (e.g., a hand) of a human body can be based on providing power from electrical power supply 30 to a heater 13 carried by heated apparel 10 (e.g., a glove 210). The heater controller 15 is interposed between electrical power supply 30 (which can include a power pack or battery pack) and the heater 13 of heated apparel 10. Heater 13 of heated apparel 10 can be based on a narrow knit electronic textile. The heating provided by the heater 13 can be monitored and controlled by heater controller 15 to provide a selected temperature, an amount of heat, etc.

The programmable control system 800 can include an analysis component 810. The analysis component 810 can include one or more electronic components which can be used to monitor and control heating by a heater 13 coupled to heated apparel 10 (e.g., a glove 210). The analysis component 810 can comprise one or more processors 812, a memory 814 coupled to the one or more processors 812, and a display 816. The display 816 can be configured and disposed to present collected data, analysis, intermediate analysis steps, instructions, algorithms, or heuristics, a thermal signature, heating data, etc. In embodiments, one or more processors 812 are connected to the memory 814, where the one or more processors 812, when executing the instructions, which are stored, are configured to control a heater 13 coupled to heated apparel 10 (e.g., a glove 210) for a portion (e.g., a hand) of a human body, wherein heating by the heater 13 is accomplished using electrical power which is supplied to heater 13 by electrical power supply 30 via the intervening heater controller 15 (which is worn on the human body).

The programmable control system 800 can include a management and power data component 820. The management portion of the management and power data component 820 can include a library of lookup tables, heater characteristics, functions, algorithms, routines, code segments, apps, etc. that can be used for management of the heater 13 carried by the heated apparel 10. The power data portion of the management and power data component 820 can include the status of a source of electrical power, power dissipation data for the heater 13, etc. The programmable control system 800 can include a coupling component 830. The coupling component 830 can act as an interface between a heater 13 of heated apparel 10 and the analysis component 810. The coupling component 830 can further act as an interface between the heater 13 and heated apparel 10 (e.g., a glove 210) for a portion (e.g., a hand) of a human body. The coupling component 830 can provide power to a heater 13 within heated apparel 10 (e.g., a glove 210), can capture status data or operating data from the heater 13 carried by the heated apparel 10 (e.g., the glove 210), etc. The coupling component 830 can act as an interface between the heater 13 of heated apparel 10 and the heater controller 15, where the heater controller 15 can be worn on the human body. The coupling of the heater controller 15 to the heater 13 of heated apparel 10 can include enabling or disabling the heater controller 15, monitoring heater controller status data such as voltage, current, or temperature, etc.

The programmable control system 800 can include computer program products (i.e., software) embodied in a non-transitory computer readable medium, the computer program products comprising code which causes one or more processors to perform the operations of controlling a heater 13 coupled to heated apparel 10 (e.g., a glove 210) for a portion (e.g., a hand) of a human body, wherein heating by the heater 13 is accomplished using electrical power, and wherein the electrical power is supplied by a heater controller 15 worn on the human body.

Each of the above methods may be executed on one or more processors on one or more computer systems. Embodiments may include various forms of distributed computing, client/server computing, and cloud-based computing. Further, it will be understood that the depicted steps or boxes contained in this disclosure's flow charts are intended to be solely illustrative and explanatory. The steps may be modified, omitted, repeated, or re-ordered without departing from the scope of this disclosure. Further, each step may contain one or more sub-steps. While the foregoing drawings and description set forth functional aspects of the disclosed systems, no particular implementation or arrangement of software and/or hardware should be inferred from these descriptions unless explicitly stated or otherwise clear from the context. All such arrangements of software and/or hardware are intended to fall within the scope of this disclosure.

The block diagrams and flowchart illustrations depict methods, apparatus, systems, and computer program products. The elements and combinations of elements in the block diagrams and flow diagrams show functions, steps, or groups of steps of the methods, apparatus, systems, computer program products and/or computer-implemented methods. Any and all such functions (generally referred to herein as a "circuit," "module," or "system") may be implemented by computer program instructions, by special-purpose hardware-based computer systems, by combinations of special purpose hardware and computer instructions, by combinations of general purpose hardware and computer instructions, and so on.

A programmable apparatus which executes any of the above-mentioned computer program products or computer-implemented methods may include one or more microprocessors, microcontrollers, embedded microcontrollers, programmable digital signal processors, programmable devices, programmable gate arrays, programmable array logic, memory devices, application specific integrated circuits, etc. Each may be suitably employed or configured to process computer program instructions, execute computer logic, store computer data, etc.

It will be understood that a computer may include a computer program product from a computer-readable storage medium and that this medium may be internal or external, removable and replaceable, or fixed. In addition, a computer may include a Basic Input/Output System (BIOS), firmware, an operating system, a database, or the like that may include, interface with, or support the software and hardware described herein.

Embodiments of the present invention are neither limited to conventional computer applications nor the programmable apparatus that run them. To illustrate: the embodiments of the presently claimed invention could include an optical computer, quantum computer, analog computer, etc. A computer program may be loaded onto a computer to produce a particular machine that may perform any and all of the depicted functions. This particular machine provides a means for carrying out any and all of the depicted functions.

Any combination of one or more computer readable media may be utilized including but not limited to: a non-transitory computer readable medium for storage; an electronic, magnetic, optical, electromagnetic, infrared, or semiconductor computer readable storage medium or any suitable combination of the foregoing; a portable computer diskette; a hard disk; a random access memory (RAM); a read-only memory (ROM); an erasable programmable read-only memory (EPROM, Flash, MRAM, FeRAM, or phase change memory); an optical fiber; a portable compact disc; an optical storage device; a magnetic storage device; or any suitable combination of the foregoing. In the context of this document, a computer readable storage medium may be any tangible medium that can contain or store a program for use by or in connection with an instruction execution system, apparatus, or device.

It will be appreciated that computer program instructions may include computer executable code. A variety of languages for expressing computer program instructions may include, without limitation, C, C++, Java, JavaScript™, ActionScript™, assembly language, Lisp, Perl, Tcl, Python, Ruby, hardware description languages, database programming languages, functional programming languages, imperative programming languages, etc. In embodiments, computer program instructions may be stored, compiled, or interpreted to run on a computer, a programmable data processing apparatus, a heterogeneous combination of processors or processor architectures, etc. Without limitation, embodiments of the present invention may take the form of web-based computer software, which includes client/server software, software-as-a-service, peer-to-peer software, etc.

In embodiments, a computer may enable execution of computer program instructions including multiple programs or threads. The multiple programs or threads may be processed approximately simultaneously to enhance utilization of the processor and to facilitate substantially simultaneous functions. By way of implementation, any and all methods, program codes, program instructions, and the like described herein may be implemented in one or more threads which may in turn spawn other threads, which may themselves have priorities associated with them. In some embodiments, a computer may process these threads based on priority or other order.

Unless explicitly stated or otherwise clear from the context, the verbs "execute" and "process" may be used interchangeably to indicate execute, process, interpret, compile, assemble, link, load, or a combination of the foregoing. Therefore, embodiments that execute or process computer program instructions, computer-executable code, or the like may act upon the instructions or code in any and all of the ways described. Further, the method steps shown are intended to include any suitable method for causing one or more parties or entities to perform the steps. The parties performing a step, or portion of a step, need not be located within a particular geographic location or country boundary. For instance, if an entity located within the United States causes a method step, or portion thereof, to be performed outside of the United States, then the method is considered to be performed in the United States by virtue of the causal entity.

Supplying Constant Power to a Given Heater 13

In the preferred form of the invention, heater controller 15 is configured to supply constant power to a given heater 13.

More particularly, in prior art heated apparel systems, the heating element of the heated apparel is connected directly to a battery. As that battery loses energy, the voltage drops, which in turn reduces the power output of the battery, and hence reduces the power which is delivered to the heating element of the heated apparel.

In contrast, in the preferred form of the present invention, heater controller 15 is configured to supply constant power to a given heater 13. This approach allows for changes in heating element resistance, both over manufacturing process variation and in changes over time and temperature, and allows for changes in battery energy. The constant power supply is based on the concept that power, P, is related to current, I, and voltage, V, by the equation:

$$P = I * V.$$

Heater controller 15 is configured so that voltage is adjusted in the circuitry to provide the correct current, such that the resulting power sent to a given heater 13 remains constant.

USB Power Delivery (PD)

As discussed above, with the present invention, power is delivered from electrical power supply 30, through the heater controller 15, to one or more articles of heated apparel 10. As also discussed above, this power is delivered using cabling which extends from electrical power supply 30 to heater controller 15, and from heater controller 15 to the one or more articles of heated apparel 10.

If desired, power may be delivered from electrical power supply 30 to heater controller 15 using a USB Power Delivery (PD) scheme, and/or power may be delivered from heater controller 15 to the one or more articles of heated apparel 10 using a USB Power Delivery (PD) scheme. With a USB Power Delivery (PD) scheme, heaters 13 of various articles of heated apparel 10 would be able to negotiate their needed voltage, up to 20 Volts DC. By leveraging USB PD's higher available voltage supplies, much lower current is required while still providing desirable power levels. For example, to allow a heater 13 to dissipate 20 watts of power, at 20 volts it will only need to draw 1 amp of current. For this same heater 13 to dissipate 20 watts of power from a 5 volt bus will require 4 amps of current. This higher current is not supported by most USB hubs, and even if it were, the higher current would necessitate the use of much larger cables/wires to carry the current efficiently. Likewise, for example, to cascade 6 heaters 13 at 5 volts drawing 4 amps each would require 24 amps of current on one cable, which would require a large cable. Leveraging USB PD's higher voltage provides a substantial advantage for powering and controlling a distributed heater system.

Connecting Multiple Articles of Heated Apparel to the Heater Controller

(i) "Hub and Spoke" USB Power Delivery (PD) Scheme

Figure 9:
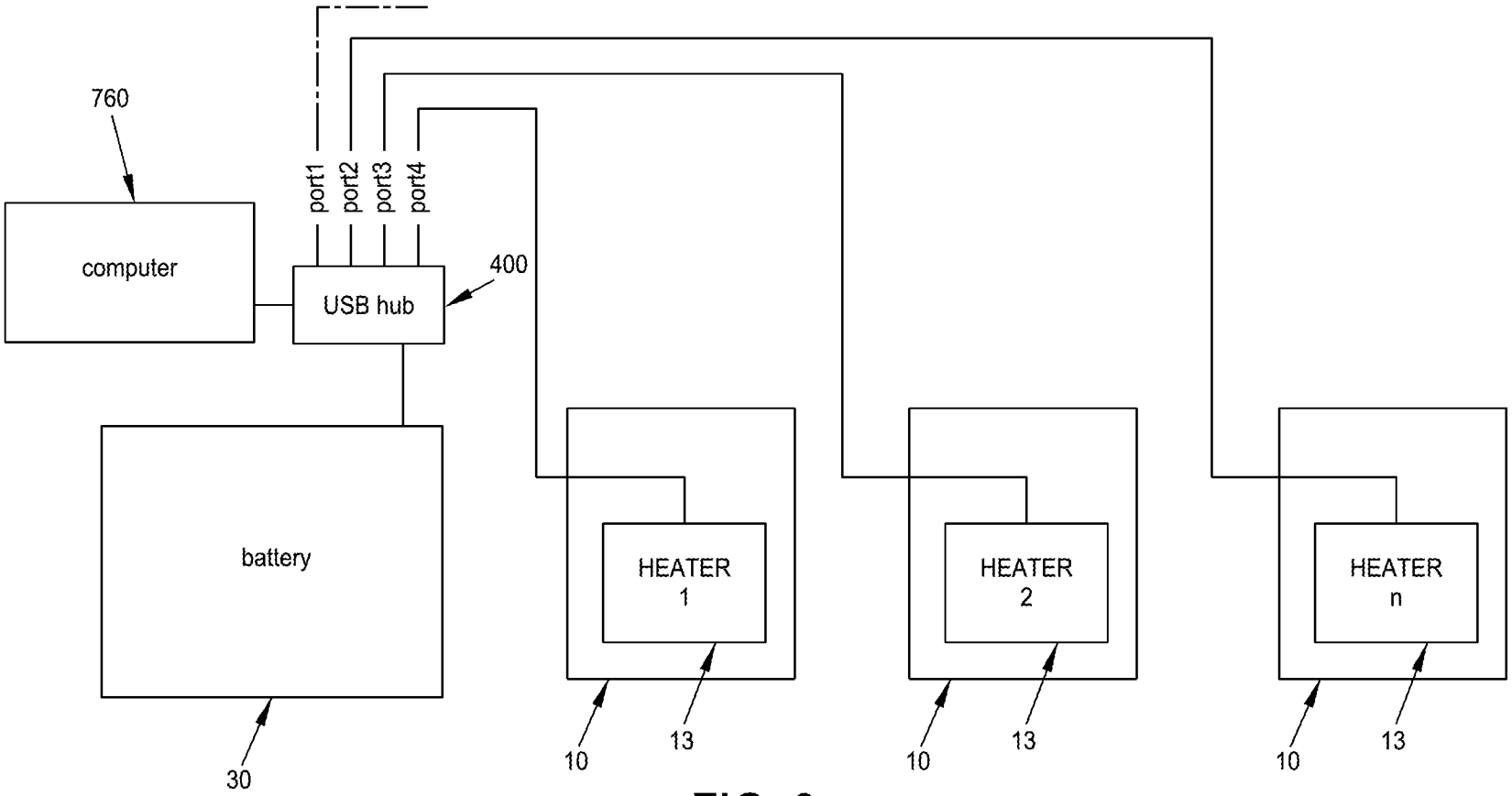
FIGS. 9 and 10 are schematic views showing different ways for supplying power to multiple articles of heated apparel.

In the system architecture discussed above, articles of heated apparel 10 are connected to heater controller 15 through a power and data management hub 400. This is essentially a "hub and spoke" system. It will be appreciated that such a "hub and spoke" system can be implemented using a variety of power distribution schemes, including a USB Power Delivery (PD) scheme. More particularly, and looking now at FIG. 9, when a USB power and data management hub 400 is connected to each heater 13 of the various articles of heated apparel 10, the USB Power Delivery (PD) scheme is essentially a "hub and spoke" configuration. The advantage of this approach is that each port on the USB power and data management hub 400 only has to provide power/current to a single heater 13, thereby allowing for smaller/lighter circuitry/cables/wires. The heaters 13 themselves are a bit less electrically complicated since they do not each require their own 2-port USB hub (as would be required if the heaters 13 were to be configured in a USB "daisy-chain" configuration, see below). Additionally, because a single USB hub may have 8 ports by itself, when several USB hubs are cascaded so as to form a power and data management hub 400, they allow for many more heaters 13 to be interfaced, theoretically as many as 127.

(ii) "Daisy-Chained"/Cascaded 2-Port USB Power Delivery (PD) Scheme

Figure 10:
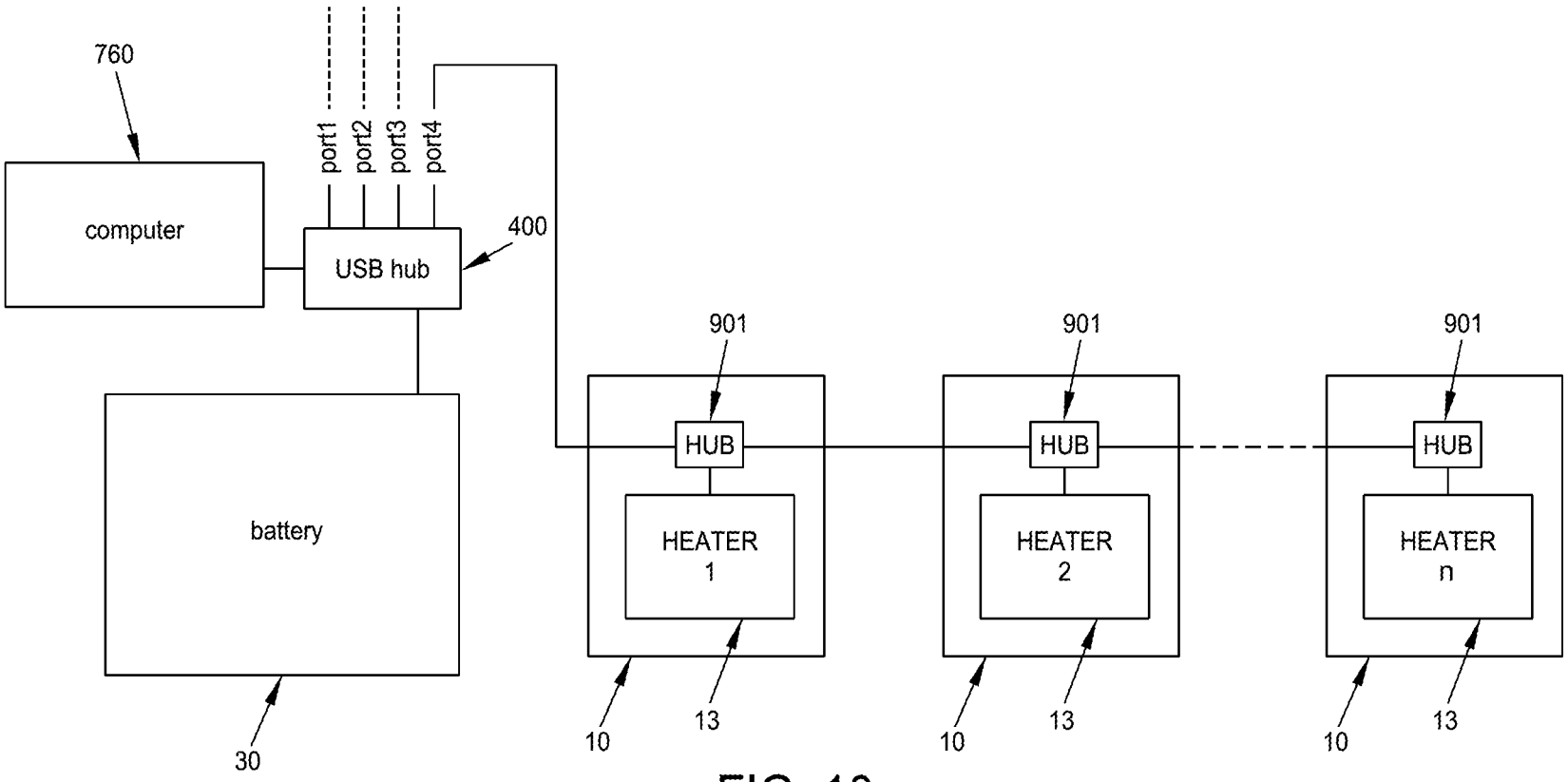

It should be appreciated that a "daisy-chained"/cascaded system can be implemented using a USB Power Delivery (PD) scheme. More particularly, and looking now at FIG. 10, when a USB power and data management hub 400 is connected to various articles of heated apparel 10, where each article of heated apparel 10 comprises a USB port 901 connected to a heater 13, the USB Power Delivery (PD)

scheme is essentially a "daisy-chained"/cascaded scheme. This approach allows several separate heaters 13 to be connected in series to one another while retaining the ability to independently control the settings of each heater 13 using the computer (e.g., smartphone or tablet 760) that is controlling the main USB hub. The advantage of this approach is the ability to simply cascade an additional article of heated apparel 10 off an existing article of heated apparel 10 (for instance, heated gloves 210 cascaded off of a heated shirt), without requiring the use of an additional port on the main USB hub 400 (leaving such ports free for other devices). The disadvantage of this approach may be that because the heaters 13 are cascading off of a single port, this port and its associated circuitry/cable/wiring needs to be of sufficient size to carry all of the current for all of the heaters 13. Also, USB architecture limits the number of hubs that can be cascaded (i.e., to 6 hubs beyond the USB host controller/computer), thus limiting how many heaters 13 may ultimately be implemented as each heater 13 has its own 2-port hub.

Magneto-Mechanically Mounted, Low-Profile, Conformal Battery for Base-Layer Wearable Applications Wearable electronic systems are in some measure limited in their application due to the difficulties in providing sufficient battery capacity for high power and/or long duration activities. Conventional batteries and their connectors and cables do not generally lend themselves to mounting on the human body in such a way as to limit negative effects on human performance. Bulky batteries stand too proud, causing snag and comfort concerns. Heavy cables and bulky connectors prove difficult to integrate with low-profile, fabric-based clothing, requiring unsightly pockets, additional layers or other undesirable solutions. A flexible, conformal, low-profile battery is proposed which addresses these current battery pack limitations and offers some additional tangential benefits.

One or more individual low-profile prismatic or other shaped battery cells form the basis for a battery pack. When multiple cells are used, they may be electrically combined in series and parallel combinations to create the desired pack power characteristics. The battery uses a high strength magnetic connector for easy, almost effortless electrical and mechanical connection with heated apparel system 5. The individual cells of the battery are arranged such that a space is maintained between them in order to allow an array of cells to bend and fold without colliding and interfering with each other. The cells may be bonded or otherwise attached to a substrate in order to hold and organize the cells in a specific desirable shape and also to prevent the cells from relative motion which may induce stress fracturing of the electrical connections between the cells. Co-located, within the space between the cells, magnet elements are fixed in such a way as to provide attraction to coincidentally-placed magnet elements located on a wearable garment. For individual cell protection and as a means for mechanically interlocking and/or keying with a garment, an impact-resistant and tear-resistant material is formed around the individual cells, and also formed over and/or around the magnet elements. This flexible and segmented battery pack is shaped to nest tightly and flexibly with a similar, but inverse-shaped, dock structure stitched or otherwise fused to a garment. This dock structure includes the coincidentally-located magnets for pulling the pack towards the dock structure, forcing the nesting engagement and keying of the battery pack and dock. It can be thought of as in the manner of how a waffle sits in a waffle tray, or a chocolate bar sits in its mold, etc. The arrayed magnets hold the pack to the dock, while both together are able to flex with the garment as worn by an active end user. The keyed "waffle" like elements provide lateral stability and reduce the shear loads that the magnets must resist. From a fashion and aesthetic perspective, the shape of the overmolded battery cell elements may be varied and arranged to form pleasing arrays. In addition, the overmolded battery elements may work in concert with other similar shaped and molded components to act as impact protection for the end user. In this case, the overmold material may be chosen for having impact-resistant characteristics such as foam structure or low durometer, etc.

Figure 10A:
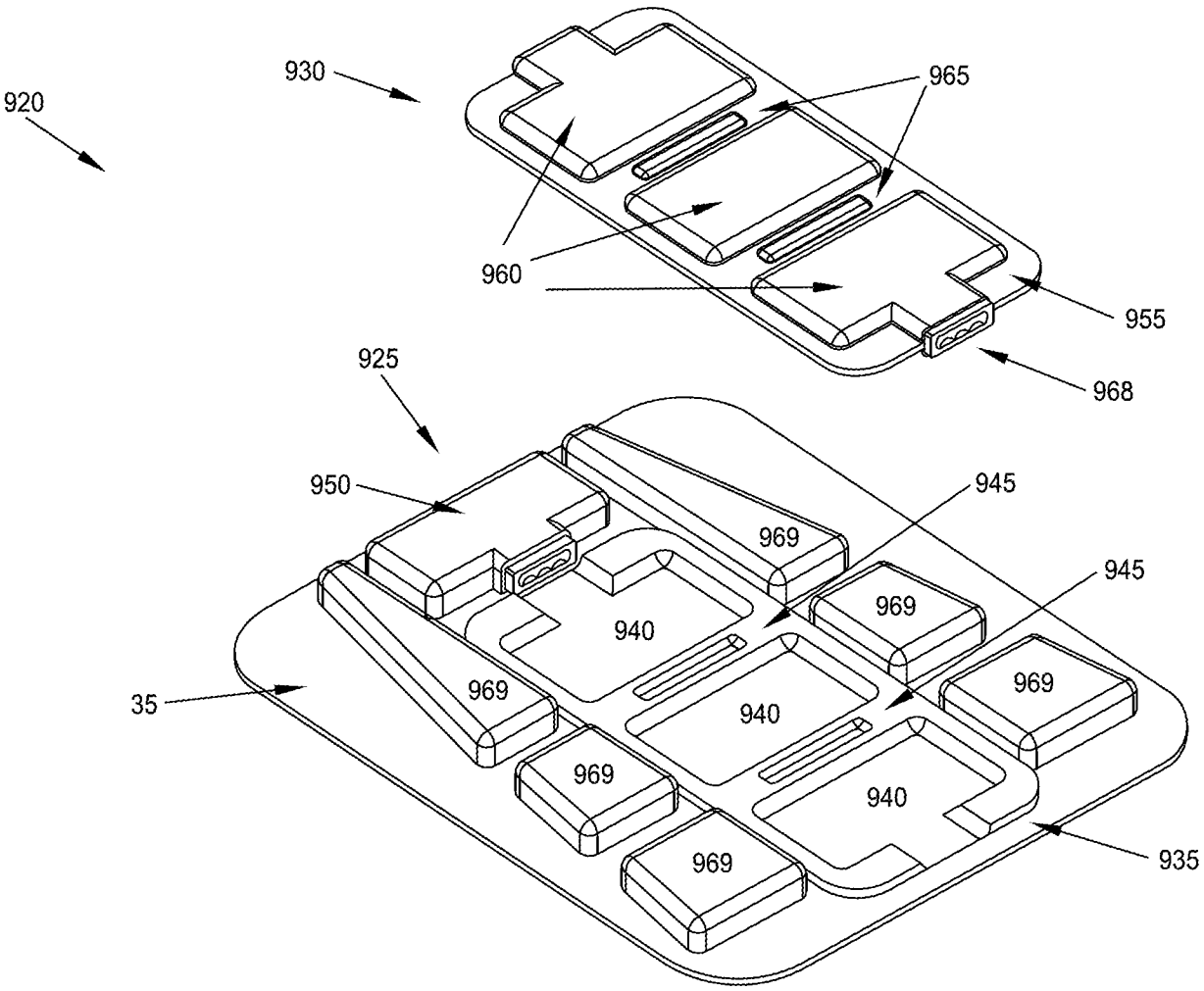
FIG. 10A is a schematic view showing a magneto-mechanically mounted, low-profile, conformal battery for base-layer wearable applications.

FIG. 10A shows one exemplary version of a magneto-mechanically mounted, low-profile, conformal battery 920. Conformal battery 920 generally comprises a battery base 925 and a battery pack 930.

Battery base 925 comprises a flexible substrate 935. Flexible substrate 935 is secured to wearable item 35 (e.g., a backpack, vest, etc.). Flexible substrate 935 is formed out of a flexible material so that battery base 925 can generally conform to the shape of the wearable item 35. Recesses 940 are formed in flexible substrate 935. Magnets 945 and electronics 950 are attached to flexible substrate 935. Electronics 950 are connected to heater controller 15 (not shown in FIG. 10A).

Battery pack 930 comprises a flexible substrate 955. Battery cells 960, magnets 965 and a magnetically-coupled connector 968 are attached to flexible substrate 955.

In use, battery pack 930 is seated in battery base 925, with battery cells 960 seating in recesses 940, magnetically-coupled connector 968 connecting to electronics 950, and magnets 945, 965 holding the assembly together.

Preferably, molded foam cushions 969 are secured to wearable item 35 on either side of battery base 925.

Figure 11:
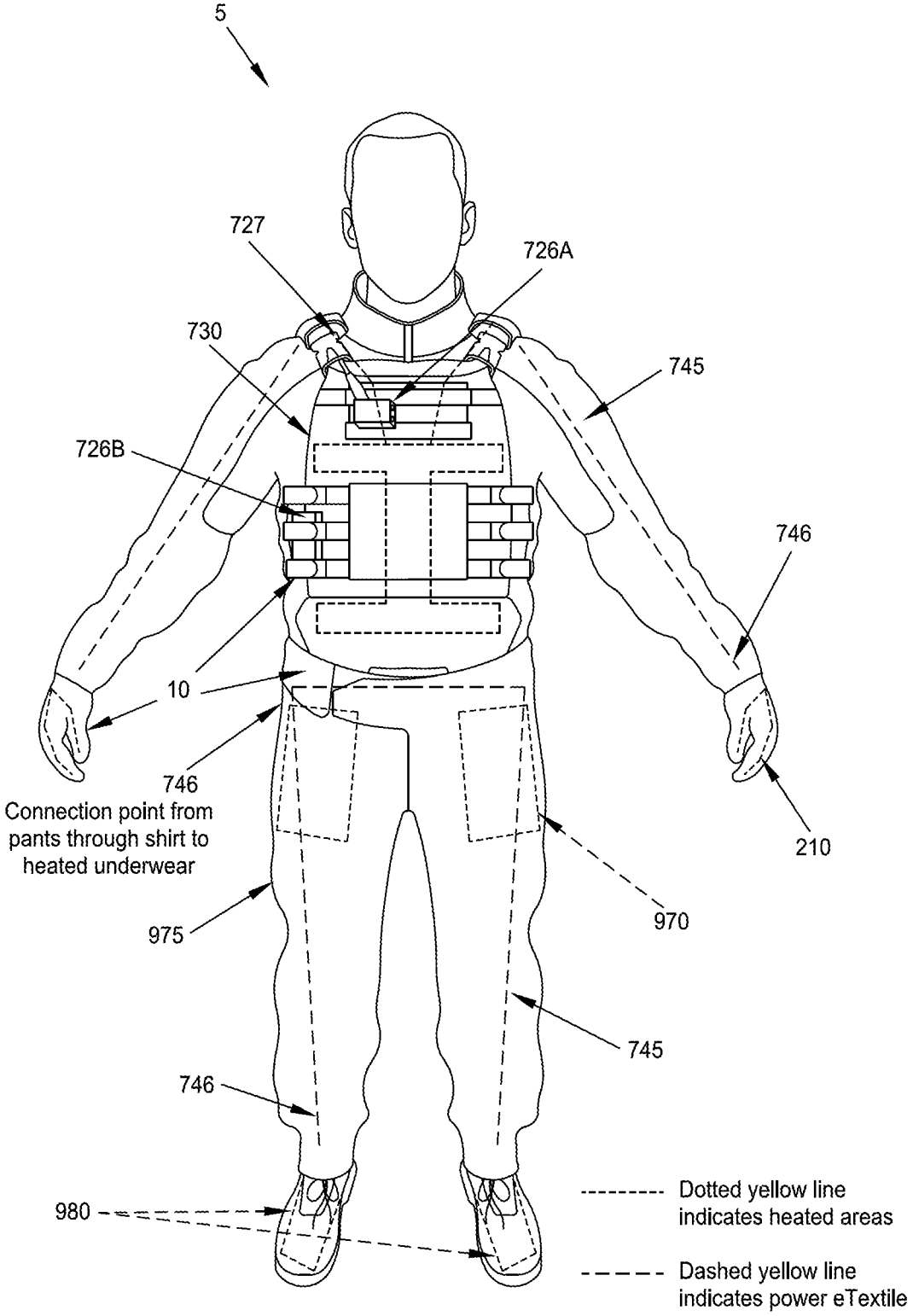
Figure 12:
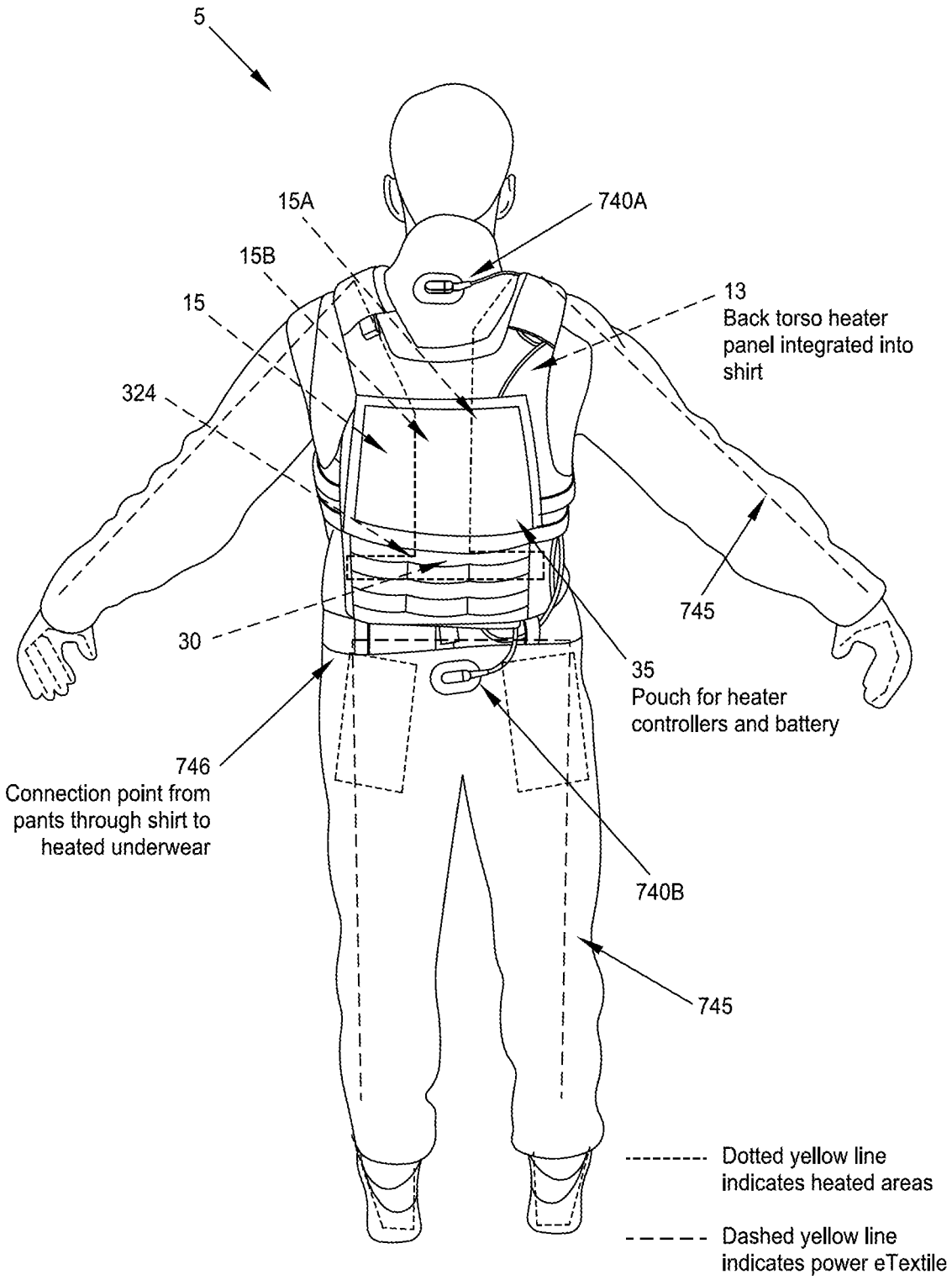
Figure 13:
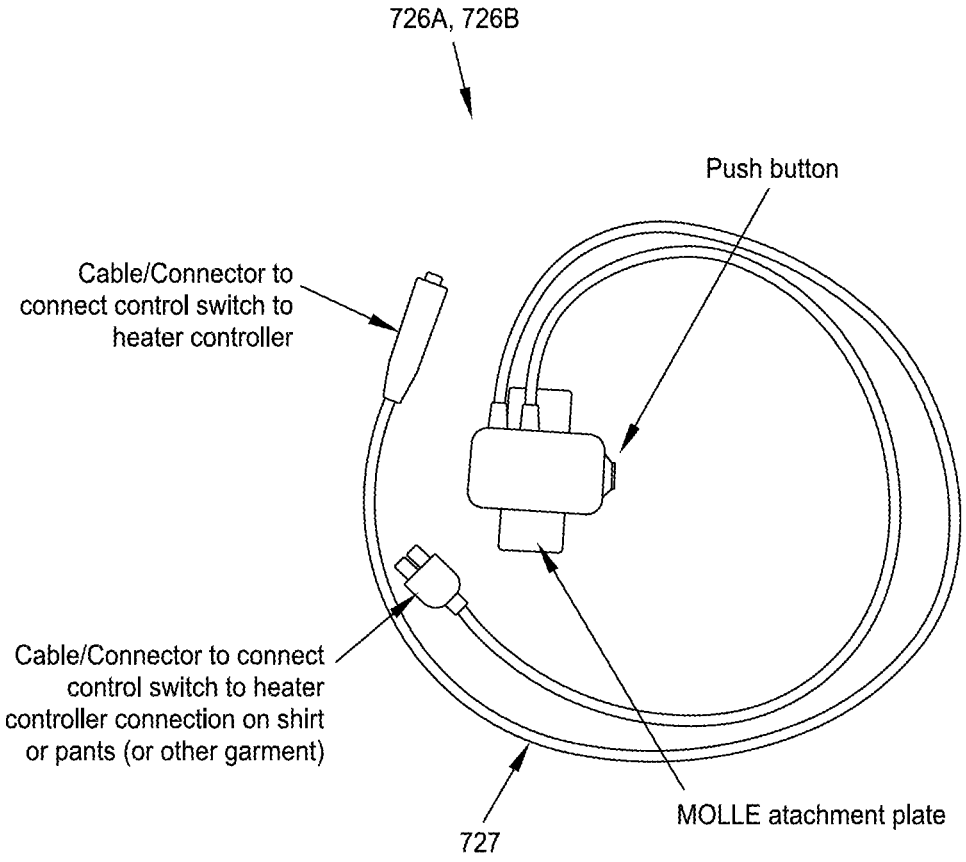
Figure 14:
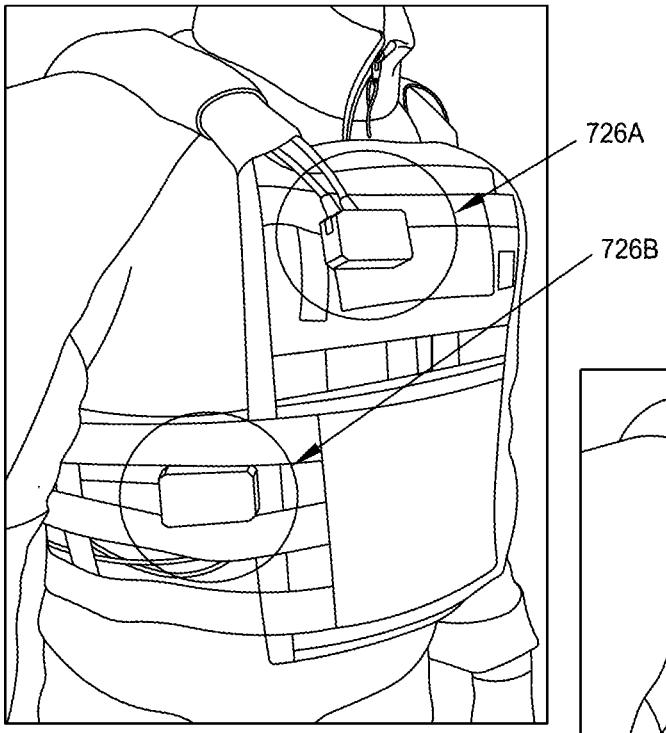
Figure 15:
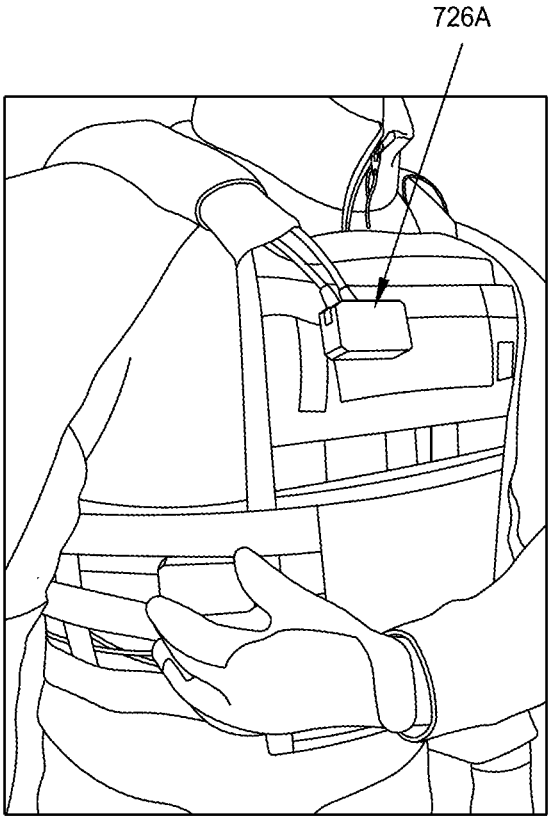
Figure 16:
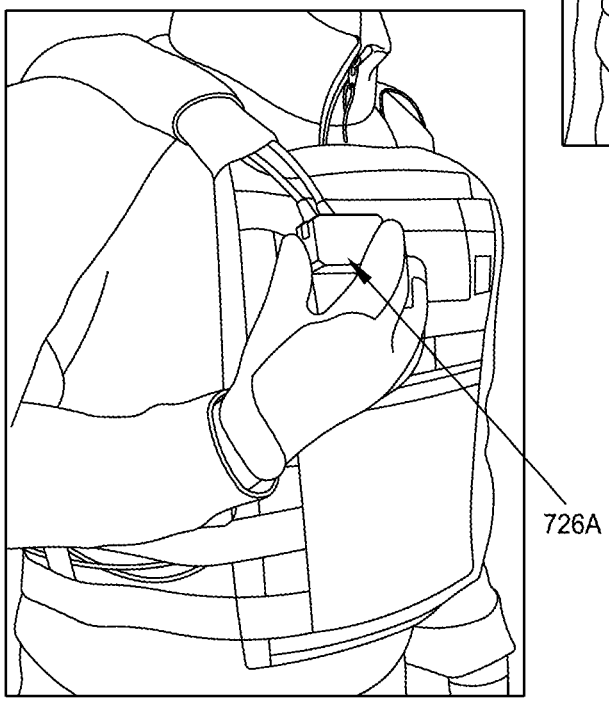

Heated Apparel System Comprising Multiple Articles of Heated Apparel with Heaters, Heater Controllers and an Electrical Power Supply FIGS. 11 and 12 show an exemplary heated apparel system 5 comprising multiple articles of heated apparel 10 with heaters 13, a heater controller 15 and an electrical power supply 30. In this exemplary heated apparel system 5, the articles of heated apparel 10 comprise a heated shirt 730, heated gloves 210, heated underwear 970, unheated pants 975, heated insoles 980, etc. All of the articles of heated apparel 10 comprise heaters 13 which are powered by heater controller 15 (either directly or indirectly), with heater controller 15 receiving its power from electrical power supply 30. Some of the articles of heated apparel 10 (e.g., the heated shirt 730 and the heated underwear 970) take their power directly from heater controller 15; other articles of the heated apparel 10 (e.g., heated gloves 210 and heated insoles 980) take their power from powered articles of apparel (e.g., the heated shirt 730 and the unheated pants 975). For purposes of the present description, the articles of apparel which pass power to other articles of apparel may sometimes be referred to as "power conducting etextiles". Power conducting etextiles comprise the aforementioned electrically conductive buses 745 which deliver power to heaters 13 carried by other heated apparel 10 (e.g., gloves 210) worn by the user. Heater controller 15 may be controlled by user controls 726. In the exemplary embodiment shown in FIGS. 11 and 12, a heater controller 15A is provided for the upper body apparel (e.g., heated shirt 730 and heated gloves 210) and a heater controller 15B is provided for the lower body apparel (e.g., heated underwear 970, unheated pants 975 and heated insoles 980). In this form of the invention, user controls 726A are provided for heater controller 15A for controlling the upper body apparel and user controls 726B are provided for heater controller 15B for controlling the lower body apparel. And in this form of the invention, heater controller 15A is connected to the upper body apparel via a connector 740A and heater controller 15B is connected to the lower body apparel via a connector 740B.

FIGS. 13-16 provide further details regarding user controls 726A and 726B. These user controls remote the control of the system from the heater controllers 15A, 15B, which in this configuration are back-mounted, and allow the user to control heat ON/OFF, as well as the levels of heat, which for this exemplary system are LOW/MED/HIGH. User controls 726A, 726B have a push button switch and provide feedback to the user as to the state of the system state—ON or OFF and level of heat—with tactile (vibratory) pulses. Note that user controls 726A, 726B may be replaced by a smartphone running an app, which would provide the user with a combination of buttons and/or slide bars to select zones and heat levels. Additionally, the user controls 726A, 726B have a feature which allows them to be mounted anywhere on a user's vest.

FIGS. 17-19 provide further details regarding the construction of "power conducting etextiles". The power conducting etextiles use electrically conductive buses 742 to deliver power to heaters 13 carried by that apparel and/or electrically conductive buses 745 which deliver power to heaters 13 carried by other heated apparel 10 (e.g., gloves 210) worn by the user. This etextile is manufactured on a standard CNC knitting machine which can control the pattern in which the wire is laid.

Figure 20:
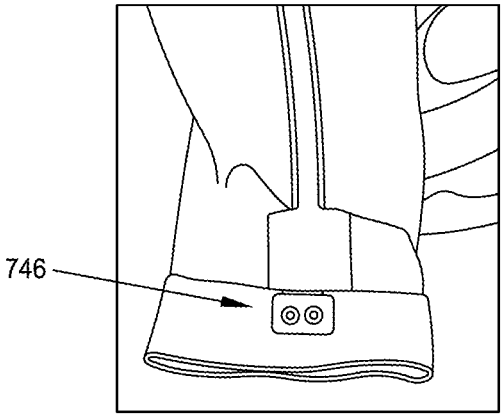
Figure 21:
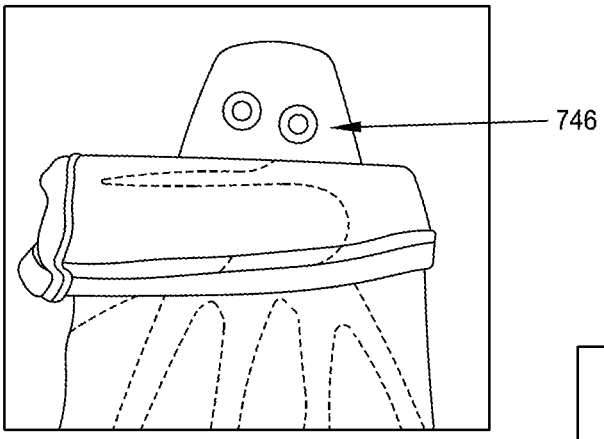
Figure 22:
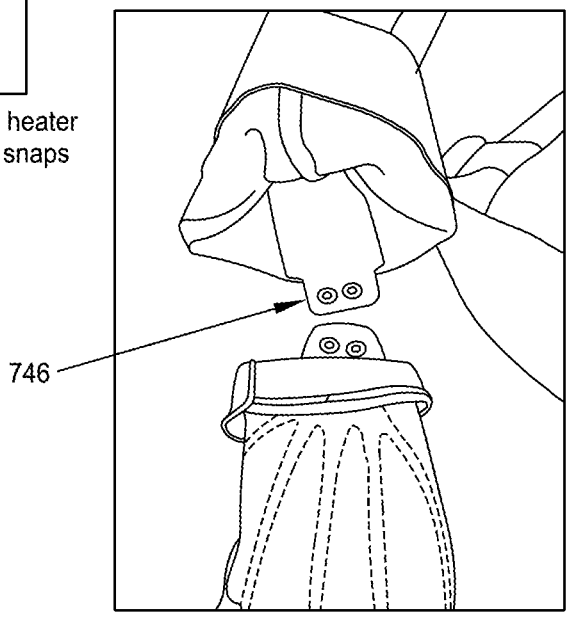
Figure 23:
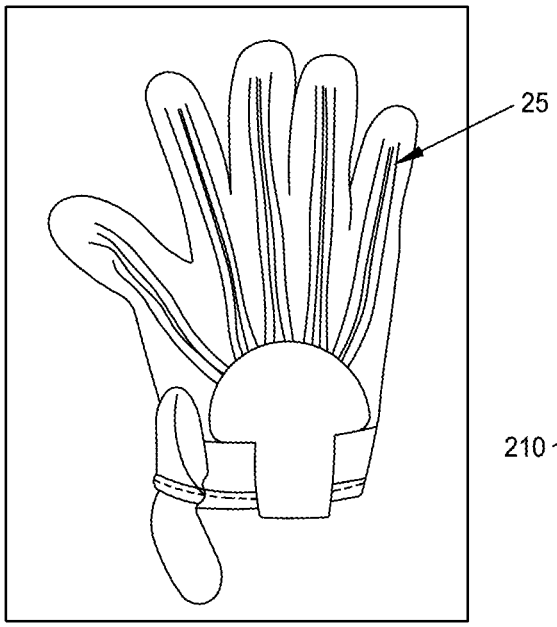
Figure 24:
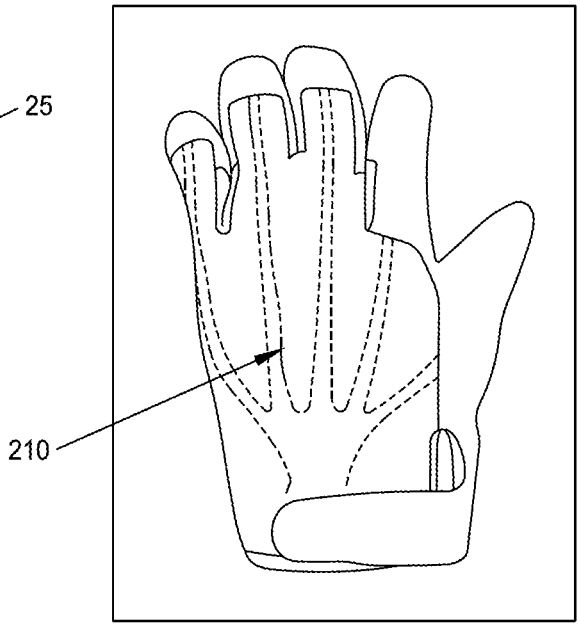
Figure 25:
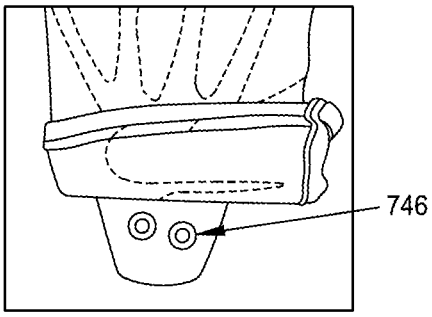
Figure 26:
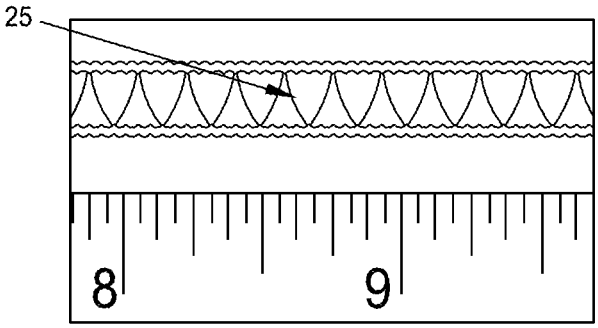

FIGS. 20-22 provide further details regarding the connection of heated gloves 210 to heated shirt 730. The medical grade snaps 746 create a low-cost, low-profile, user-friendly, easily connected and disconnected connection between the power conducting etextiles (of the heated shirt 730 or unheated pants 775) to the peripheral heated garment (e.g., heated gloves 210, heated underwear 970, heated insoles 980).

FIGS. 23-26 provide further details regarding heated gloves 210. Using a computer-controlled knitting process, a resistive yarn is knitted into a narrow elastic band. This yarn can be, for example, stranded stainless steel or silver coated nylon, and can be made of different thicknesses or made from multiple strands to customize their electrical properties, such as resistance. Additionally, the resistance per foot of the knitted narrow band can be further modified by varying the pitch and amplitude of the wave pattern in which the resistive yarn is laid into the narrow band. Because resistance of the heater 13 is a critical parameter for the heat output of the system, being able to tailor the resistance of the heater 13 is critical to the design and manufacture of the system. Resistive yarns in a knitted elastic band is only one of the potential ways to form heater 13. Others include: Positive Temperature Coefficient (PTC) ink-based heater panels, embroidered resistive yarns, liquid metal inks, etc.

Figure 27:
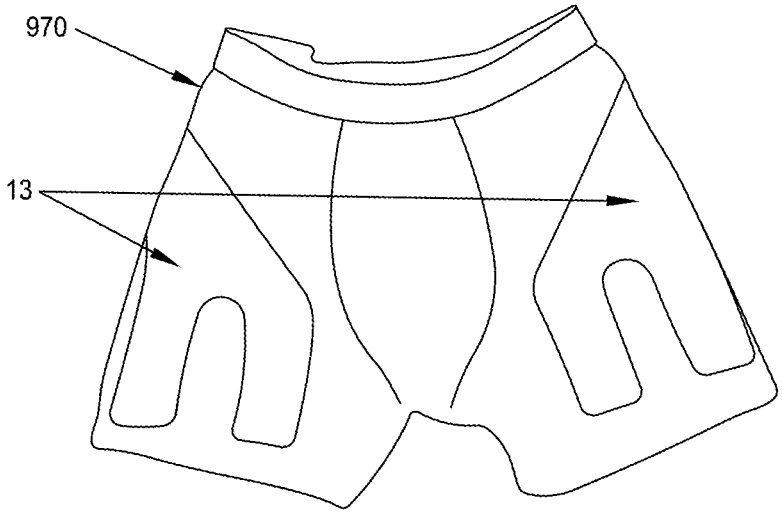
Figure 28:
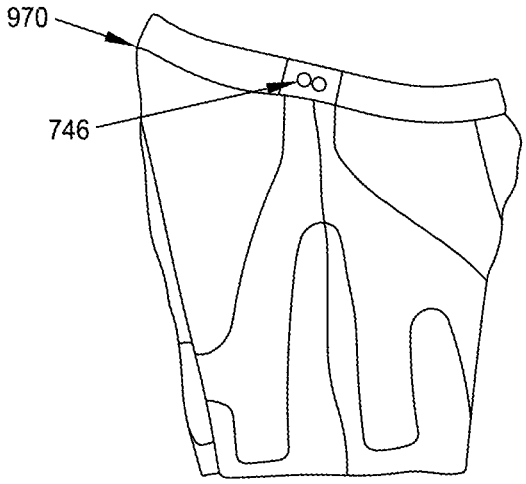
Figure 29:
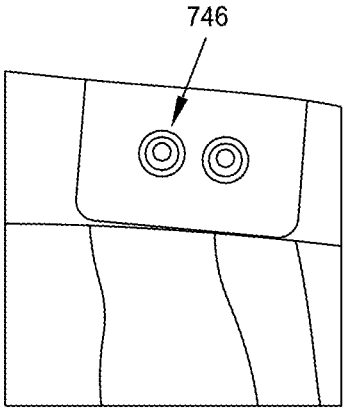

FIGS. 27-29 provide further details regarding heated underwear 970.

Figure 30:
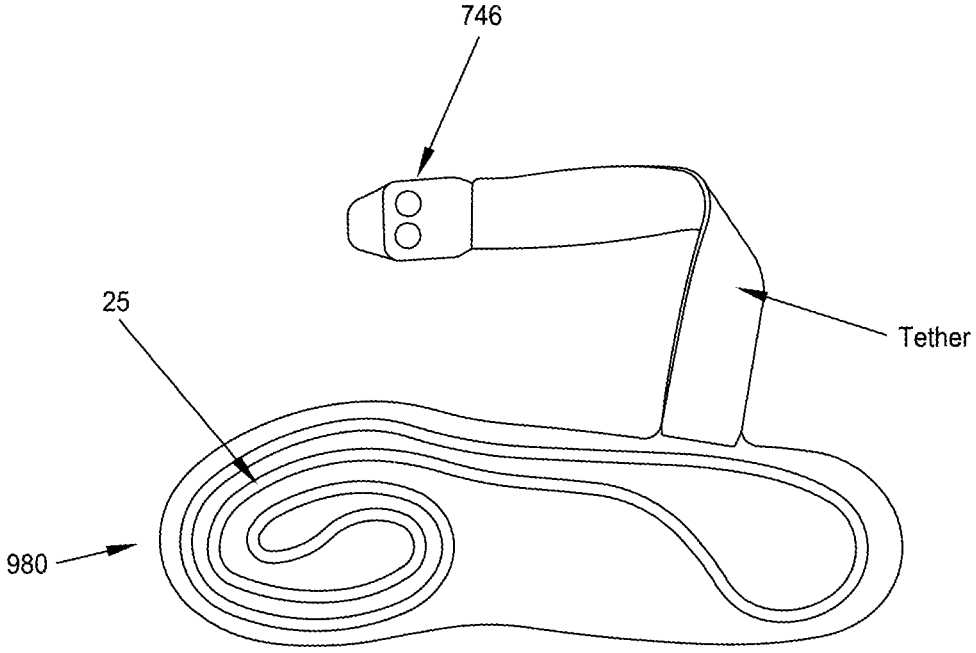

FIG. 30 provides further details regarding heated insoles 980. The heated insoles 980 are preferably made by laser cutting a pathway into a rubber-like substrate (neoprene sheet) and installing the etextile heater 13 into the pathway and covering the top and bottom with a fabric substrate. This embeds the heater 13 into a substrate of similar thickness to keep the surface as flat as possible to reduce any irritation inside the shoe/boot. The pathway for the heater 13 can be positioned anywhere that heat is wanted. The heater 13 is run up the tether to the snap connection 746.

Figure 31:
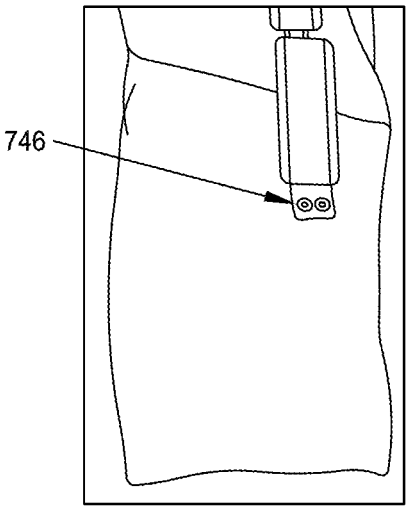
Figure 32:
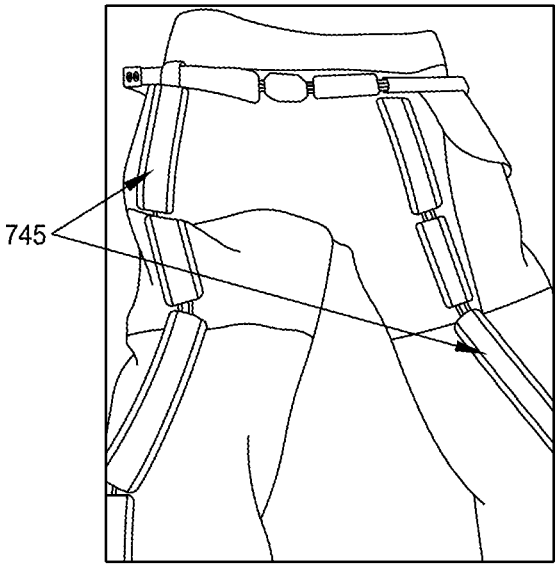
Figure 33:
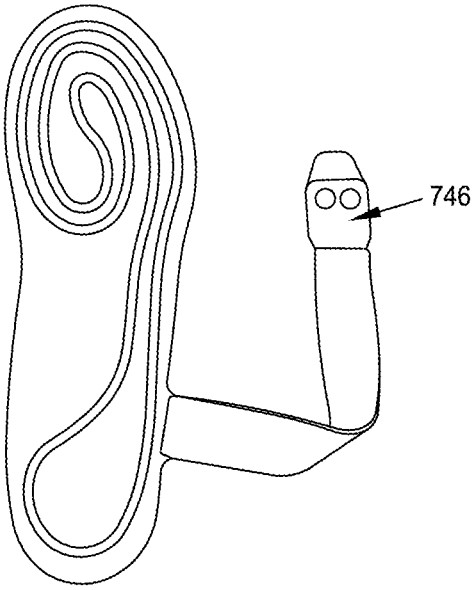

FIGS. 31-33 provide further details regarding the connection of unheated pants 975 to heated insoles 980. The power bus 745 to heated insole connection 746 is analogous to the power bus 745 to heated glove connection 746.

Figure 34:
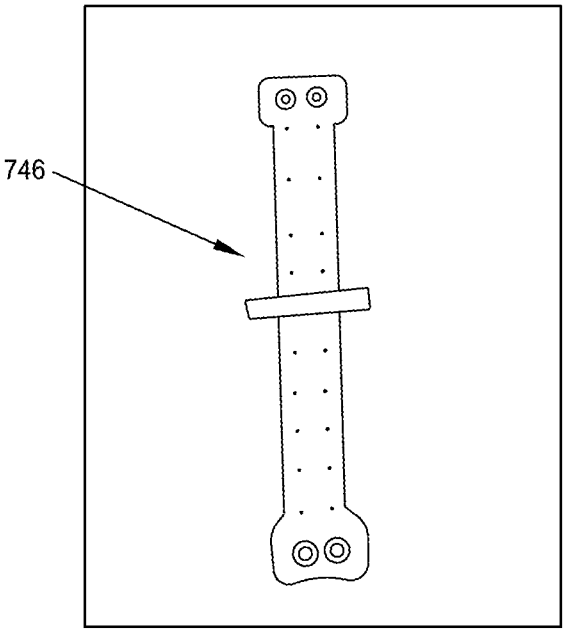
Figure 35:
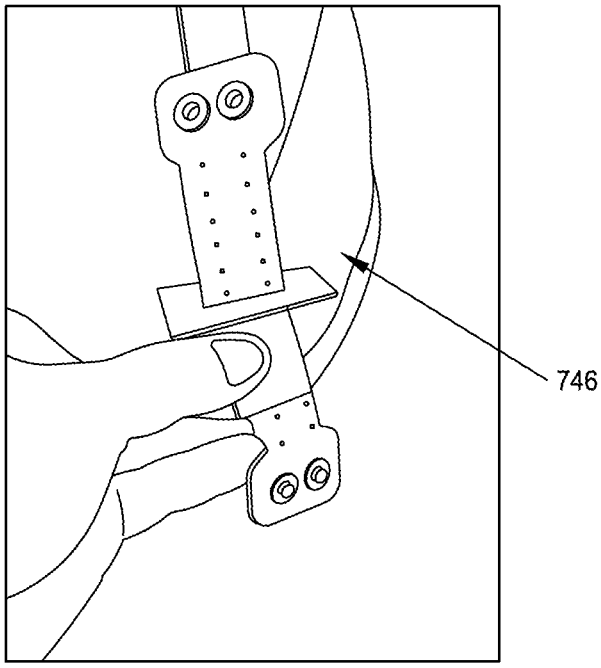

FIGS. 34 and 35 provide further details regarding the connection of the heated underwear 970 to the unheated pants 975.

Figure 36:
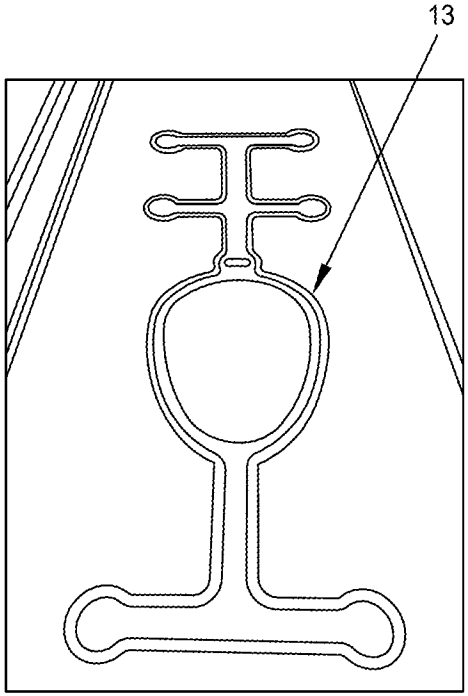
Figure 37:
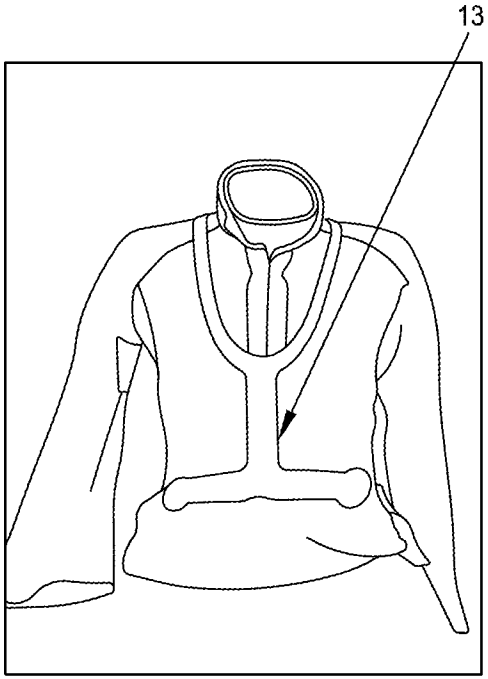
Figure 38:
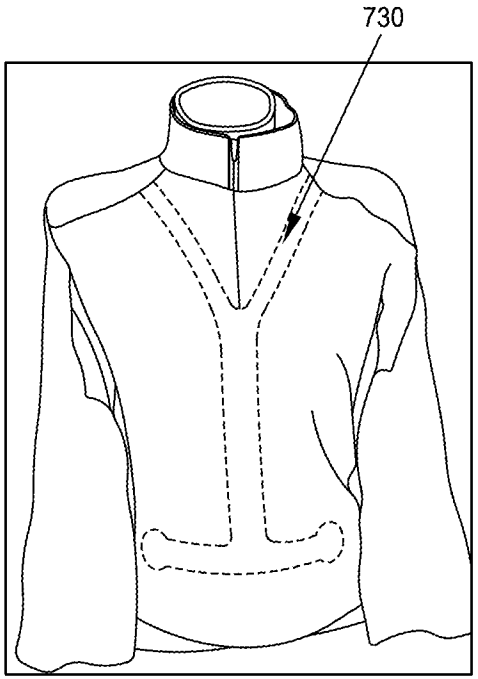
Figure 39:
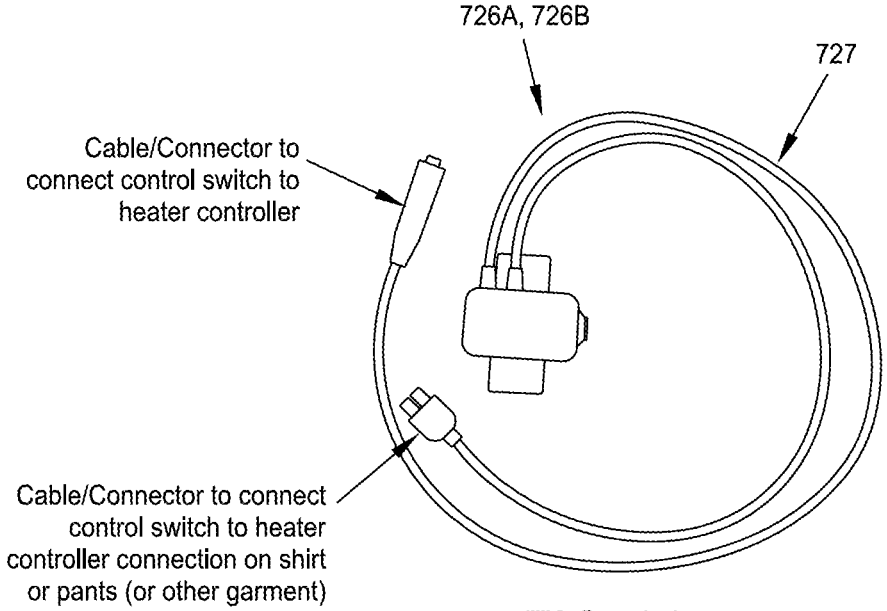
Figure 40:
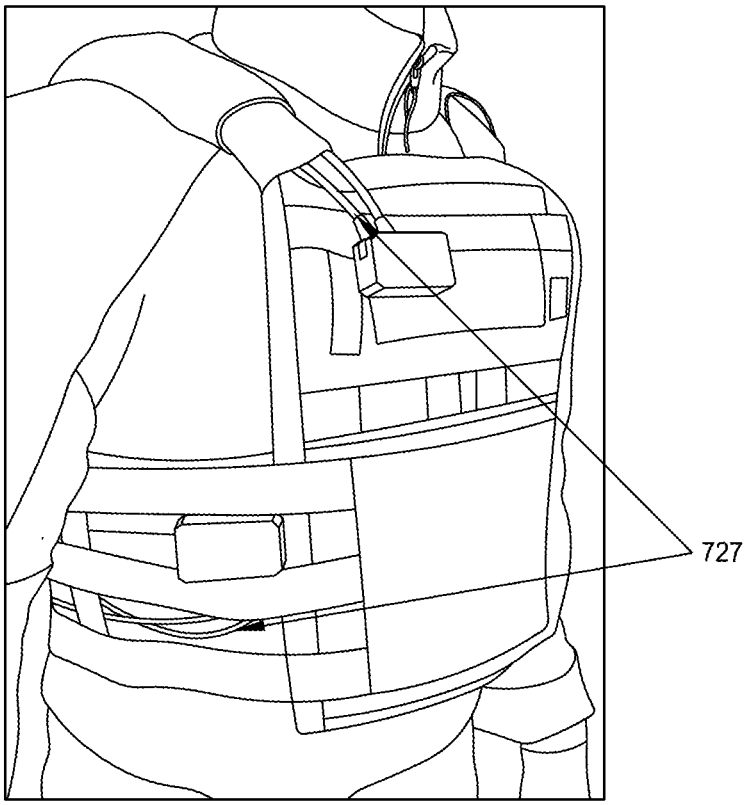
Figure 41:
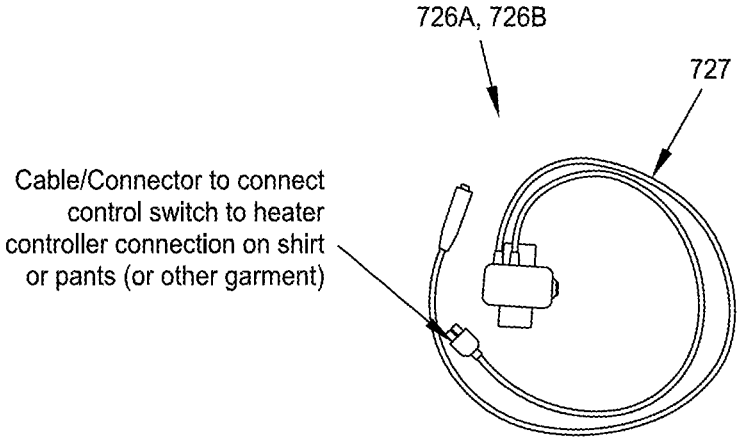
Figure 42:
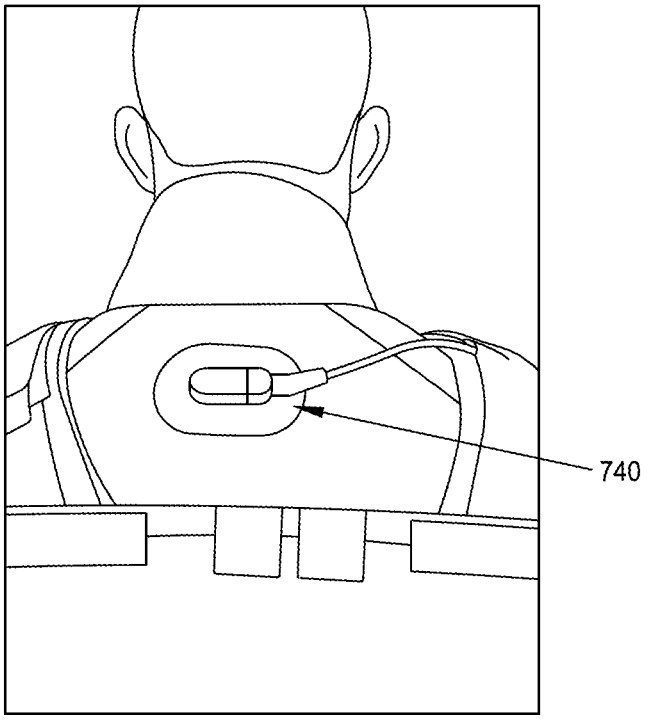

FIGS. 36-38 provide further details regarding the front heater 13 of heated shirt 730. The pattern for the heater 13, which is made up of the etextile heating element 25 affixed to a fabric substrate and the connection point 740 out to the heater controller 15A, is determined based on the design of the garment into which it will be installed and the location of where the heat is to be delivered. Even though it is shown as a front torso heater in FIGS. 36-38 and a back torso heater in FIGS. 43 and 44 (see below), in the current design the heater 13 for heated shirt 730 is all one construction.

FIGS. 39-42 provide further details regarding the user controls 726A for controlling the upper body heated apparel. As described above, the user control 726A remotes the control of the system from the heater controller 15A, which in this configuration is back-mounted, allowing the user to control ON/OFF, as well as the levels of heat. The user controls 726A, 726B are front-mounted to make access easy for the user, but this means that cables 727 need to be routed to the back-mounted heater controller 15A, and it is important to bury the cables 727 to minimize snag hazards. A 2-prong connector port 740 (which uses stereo jack connectors) is integrated into the upper center back of the heated shirt 730. This connects, as part of the heater 13 that is integrated into the heated shirt 730, to both the shirt-integrated heater 13 and the power bus 745 which extends down to the glove connectors 746. The 2-prong connector 740 on the user control 726A (for the upper body heater controller 15A) plugs into this port.

Figure 44:
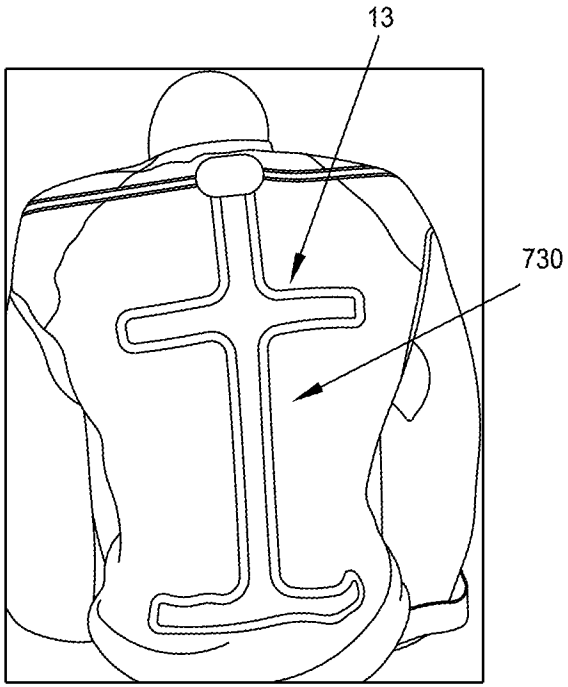
Figure 43:
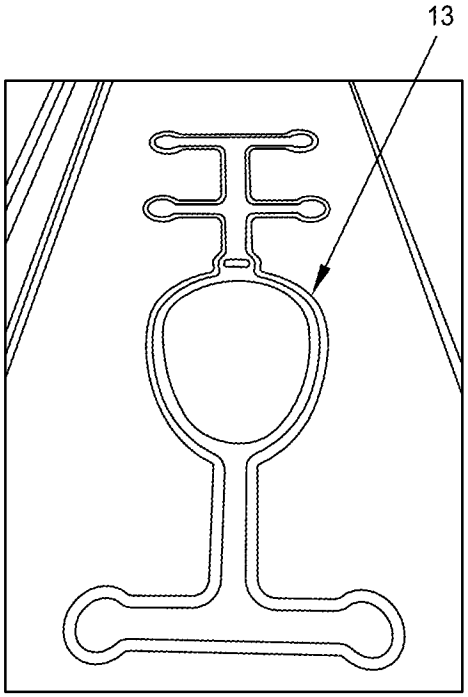

FIGS. 43 and 44 provide further details regarding the back heater 13 of heated shirt 730. The pattern for the heater 13, is made up of the etextile heating element 25 affixed to a fabric substrate and the connection point 740 out to the heater controller 15A, is determined based on the design of the garment into which it will be installed and the location of where the heat is to be delivered. Even though it is shown as a front torso heater in FIGS. 36-38 (see above) and a back torso heater in FIGS. 43 and 44, in the current design heater 13 for heated shirt 730 is all one construction.

Figure 45:
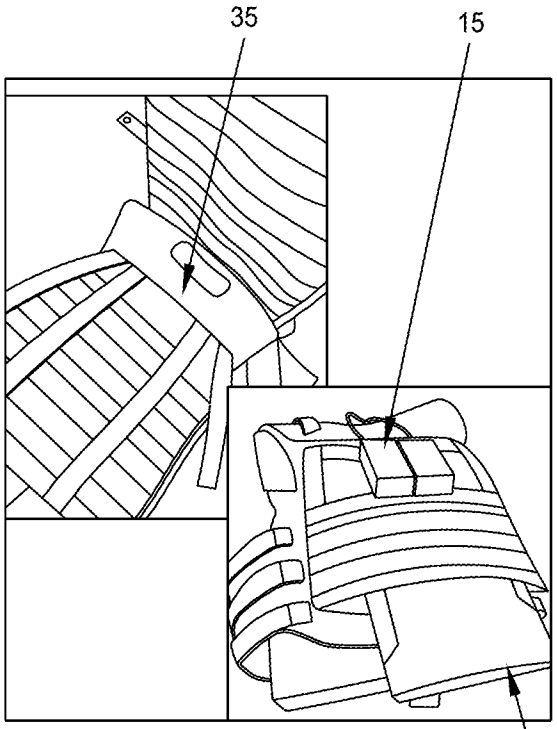
Figure 46:
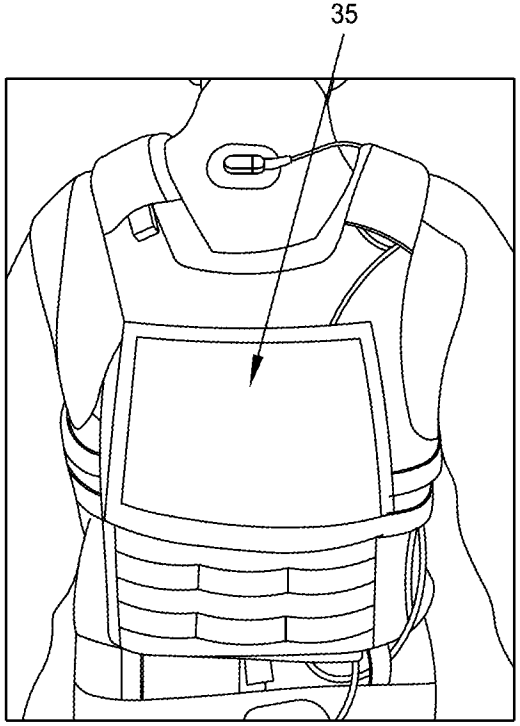
Figure 47:
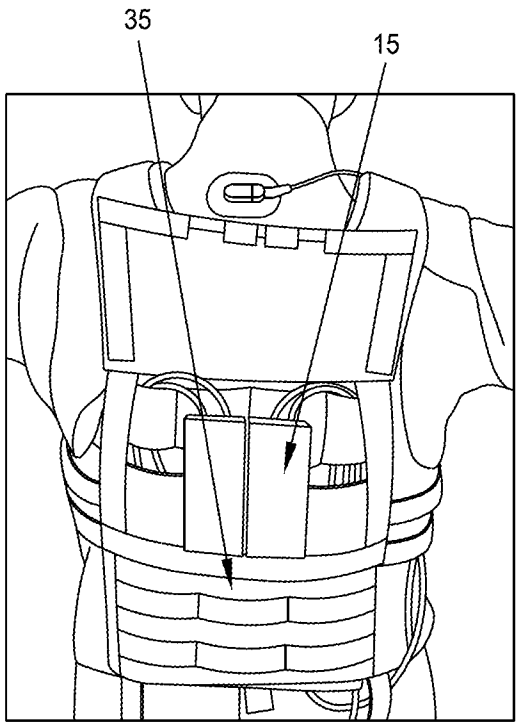

FIGS. 45-47 provide further details regarding the pouch of wearable item 35. The pouch of wearable item 35 is designed to tightly integrate the electrical modules (heater controller 15 and user controls 726) into the soldier vest. Instead of a wearable battery 324, electrical power supply 30 can be replaced by a cable to connect to an alternative power source such as vehicle or cockpit power.

Figure 48:
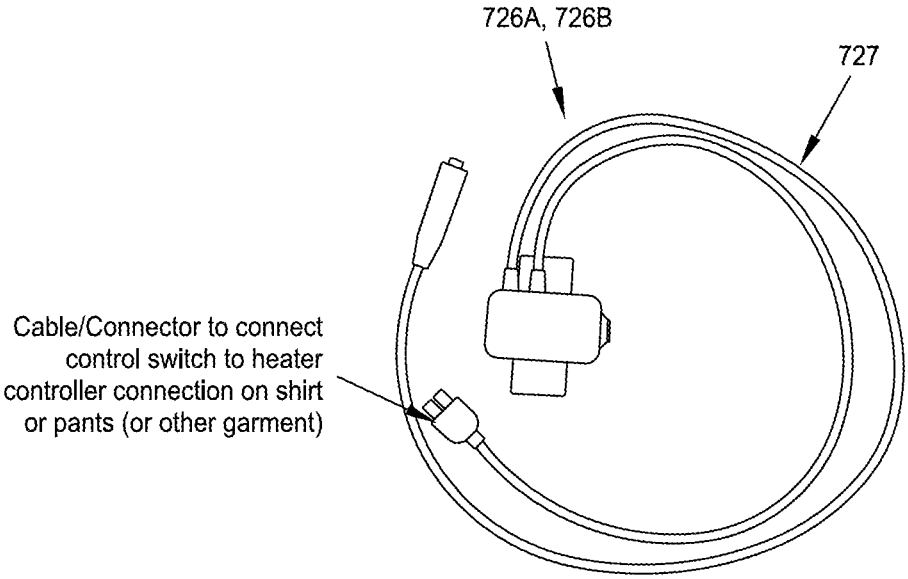
Figure 49:
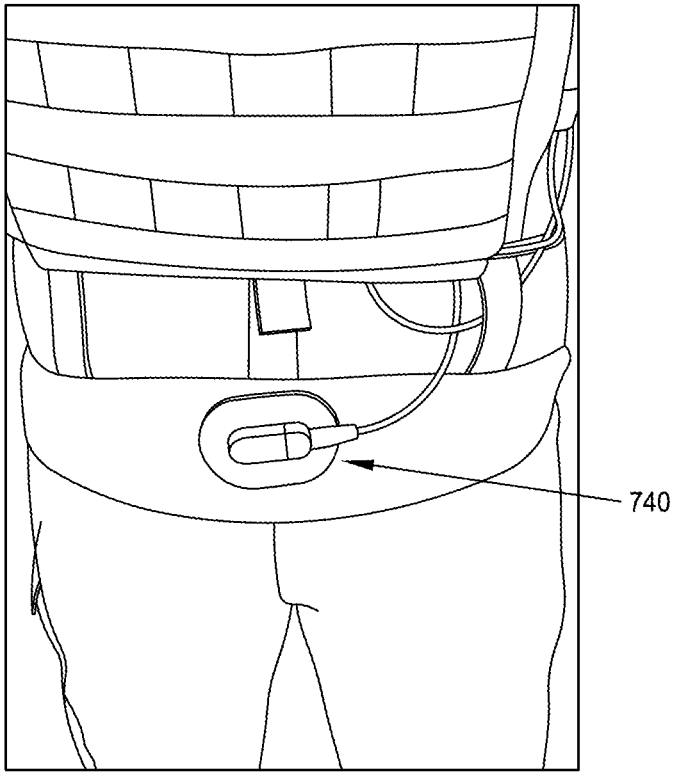
Figure 50:
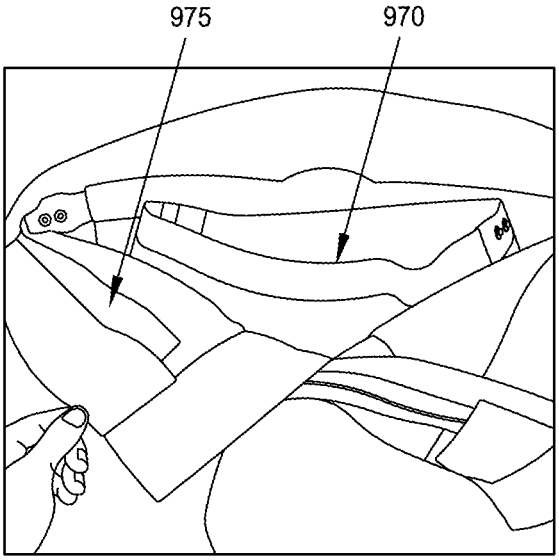
Figure 51:
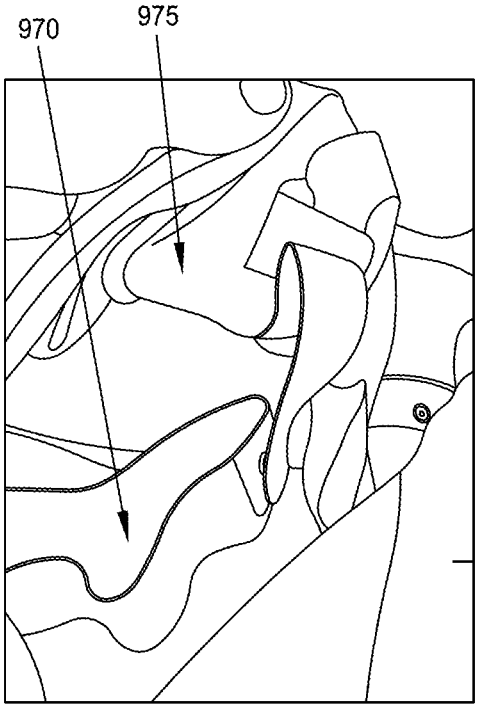
Figure 52:
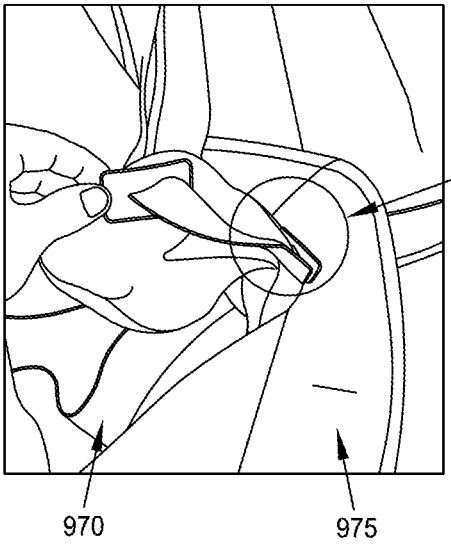
Figure 53:
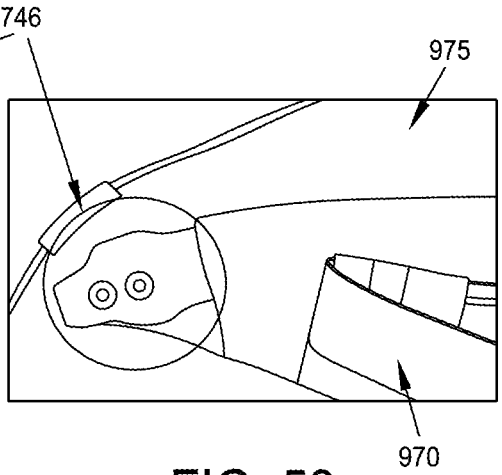

FIGS. 48 and 49 provide further details regarding the user controls 726B for controlling the lower body heated apparel. A 2-prong connector port 740 (which uses stereo jack connectors) is integrated into the upper center back of the unheated pants 975. This connects, as part of the heater 13 that is integrated into the heated shirt 730, to both the connection point from the unheated pants 975 through the heated shirt 730 to the heated underwear 970 and the power bus 745 down to the insole connectors 746. The 2-prong connector 740 on the lower body user controls 726B (above) plugs into this port.

FIGS. 50-53 provide further details regarding the connection of the heated underwear 970 to the unheated pants 975. To connect from the outside of the unheated pants 975 through to the heated underwear 970 when wearing a tucked-in shirt 730, there is provided an electrical connection pass through in the bottom portion of the shirt 730 which has snap connections 746 for both the electrically conductive buses 745 of the unheated pants 975 and the electrically conductive buses 742 of the heated underwear 970.

Figure 56:
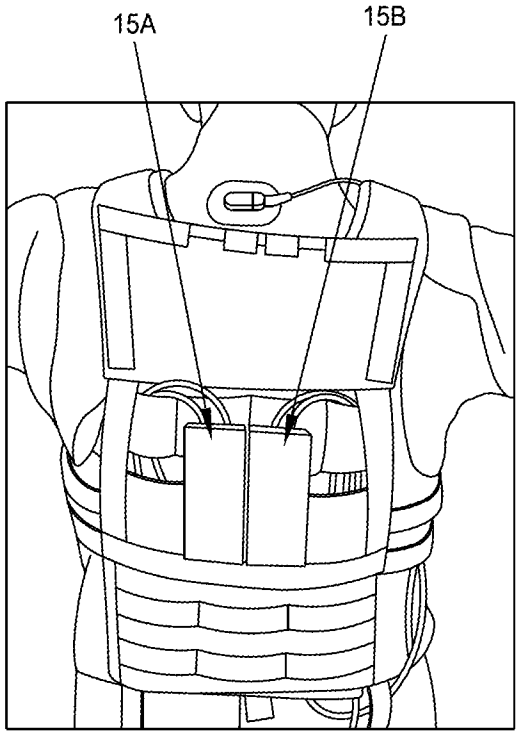
Figure 55:
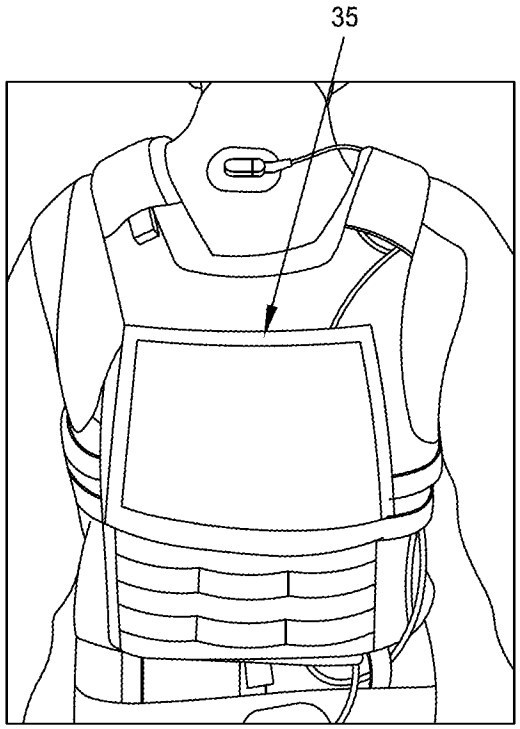
Figure 54:
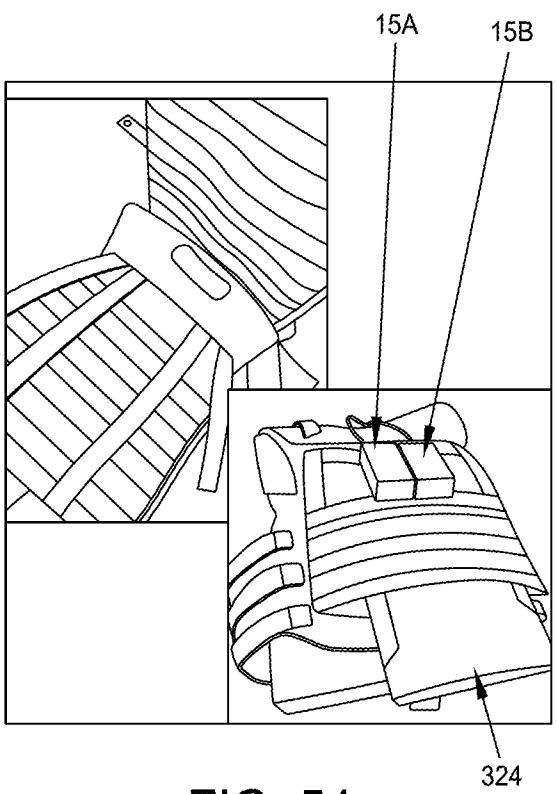

FIGS. 54-56 provide further details regarding electrical power supply 30. The system can be operated using a wearable battery 324 (as shown above) being inserted into the pouch of the wearable item 35 or from a remote (off body) source using a cable.

Figure 57:
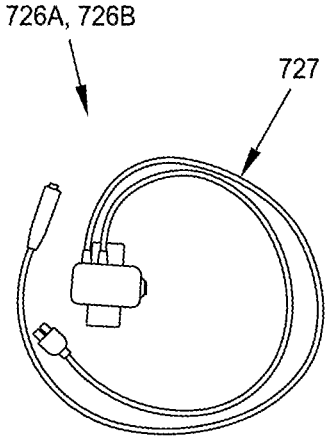
Figure 58:
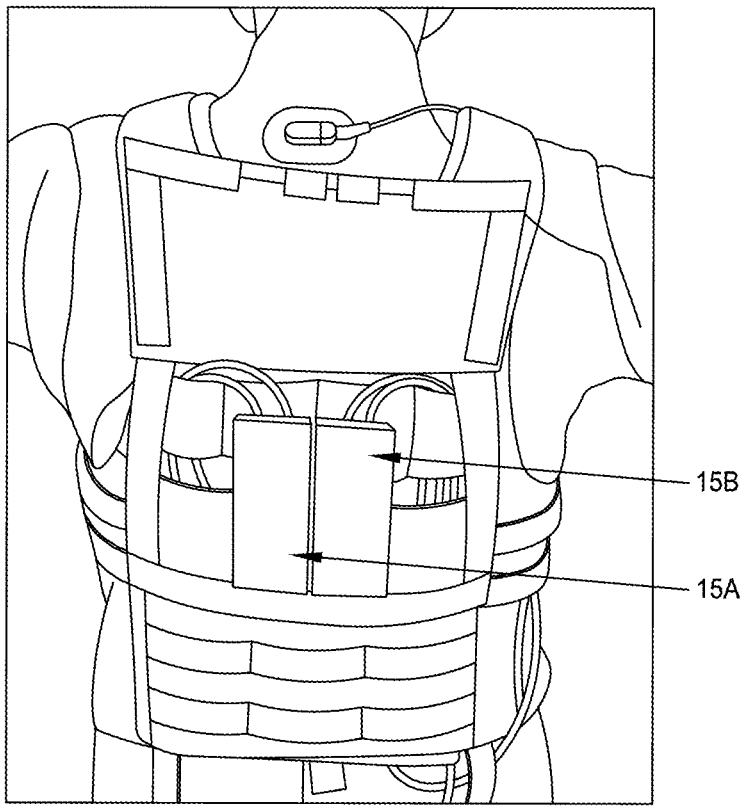

FIGS. 57 and 58 provide further details regarding the heater controller 15. The heater controllers 15A, 15B control the battery voltage based on power levels selected using the user controls 726A, 726B. In this case heater controllers 15A, 15B are mounted on the back because they do not have any user interface. The power control is remoted (to the front of the vest) in the form of the user controls 726A, 726B.

MODIFICATIONS

While the invention has been disclosed in connection with preferred embodiments shown and described in detail, various modifications and improvements thereon will become apparent to those skilled in the art. Accordingly, the foregoing examples should not limit the spirit and scope of the present invention; rather it should be understood in the broadest sense allowable by law.

What is claimed is:

1. A heated apparel system comprising:

an e-textile heater element harness;

at least one article of apparel, wherein the e-textile heater element harness is laminated or stitched onto the at least one article of apparel;

an electrical power supply; and a heater controller being connectable to the electrical power supply and the e-textile heater element harness, the heater controller comprising:

a control component configured to monitor and control the electrical power delivered to the e-textile heater element harness from the electrical power supply.

2. A heated apparel system according to claim 1 wherein the at least one article of apparel comprises at least one from the group consisting of a shirt, sweater, coat, pants, underwear, socks, hat, balaclava, scarf, neck warmer, gloves, mittens, compression sleeves, insoles, shoes and boots.

3. A heated apparel system according to claim 1 wherein the e-textile heater element harness comprises electrically-resistive material.

4. A heated apparel system according to claim 3 wherein the electrically-resistive material comprises at least one from the group consisting of electrically-resistive wire, conductive textile, conductive ink, conductive polymer, a Positive Temperature Coefficient (PTC) ink-based heater panel, liquid metal alloy and polymerized liquid metal network.

5. A heated apparel system according to claim 1 wherein the control component of the heater controller is configured to control the electrical power delivered to the e-textile heater element harness based on the health of the electrical power supply.

6. A heated apparel system according to claim 1 wherein the control component of the heater controller is further configured to monitor a temperature of the at least one article of apparel and to control the electrical power delivered to the e-textile heater element harness based on such monitoring.

7. A heated apparel system according to claim 1 wherein the control component of the heater controller is configured to control the electrical power delivered to the e-textile heater element harness based on a temperature measurement of a portion of the user's body.

8. A heated apparel system according to claim 1 wherein the control component of the heater controller is configured to control the electrical power delivered to the e-textile heater element harness based on a temperature measurement on an outside surface of the at least one article of apparel.

9. A heated apparel system according to claim 1 wherein the control component of the heater controller is configured to control the electrical power delivered to the e-textile heater element harness based on a required heating duration.

10. A heated apparel system according to claim 1 wherein the control component of the heater controller is configured to control the electrical power delivered to the e-textile heater element harness based on the electrical power available from the electrical power supply.

11. A heated apparel system according to claim 1 wherein the control component of the heater controller is configured to control the electrical power delivered to the e-textile heater element harness based on the electrical power requirements for other devices connected to the electrical power supply.

12. A heated apparel system according to claim 1 wherein the control component of the heater controller is configured to control the electrical power delivered to the e-textile heater element harness based on a user setting supplied to the heater controller.

13. A heated apparel system according to claim 12 wherein the control component of the heater controller is configured to control the electrical power delivered to the e-textile heater element harness so as to maintain a level corresponding to the user setting regardless of power consumption.

14. A heated apparel system according to claim 1 wherein the heater controller is configured to provide constant power to the e-textile heater element harness.

15. A heated apparel system according to claim 1 wherein the heater controller is configured so as to maintain a constant temperature at the e-textile heater element harness.

16. A heated apparel system according to claim 1 wherein the at least one article of apparel does not carry the heater controller.

17. A heated apparel system according to claim 1 further comprising a third wearable item, wherein the heater controller is carried by the wearable item.

18. A heated apparel system according to claim 17 wherein the wearable item comprises at least one from the group consisting of a belt, a garment having a pocket, harness, vest, clip, backpack, waist pack, field bag, pouch and satchel.

19. A heated apparel system according to claim 1 wherein the electrical power supply comprises a battery.

20. A heated apparel system according to claim 19 wherein the battery is configured to be carried by the user.

21. A heated apparel system according to claim 1 wherein the electrical power supply comprises a power generation system.

22. A heated apparel system according to claim 21 wherein the power generation system comprises at least one from the group consisting of a system configured to generate electrical power from movement of the body, a system configured to generate electrical power from solar energy and a system configured to generate electrical power from a fuel cell.

23. A heated apparel system according to claim 21 wherein the power generation system is configured to be carried by the user.

24. A heated apparel system according to claim 1 wherein the electrical power supply comprises the electrical system of a vehicle or an aircraft.

25. A heated apparel system according to claim 1 wherein the heater controller is connected to the e-textile heater element harness using a USB Power Delivery (PD) scheme.

26. A heated apparel system according to claim 1 wherein the heated apparel system comprises at least two articles of apparel, and further wherein the at least two articles of apparel are connected to the heater controller using a hub and spoke power delivery scheme.

27. A heated apparel system according to claim 1 wherein the heated apparel system comprises at least two articles of apparel, and further wherein the at least two articles of apparel are connected to the heater controller using a daisy-chain/cascaded power delivery scheme.

28. A heated apparel system according to claim 1 wherein the heated apparel system further comprises a power and data management hub, and further wherein the at least one article of apparel and the heater controller are electrically connected through the power and data management hub.

29. A heated apparel system according to claim 1 wherein the heater controller comprises at least one from the group consisting of a smartphone, a tablet and a computer.

30. A heated apparel system according to claim 1, wherein the heater controller is wearable by the user;

and further wherein the heater controller is configured to provide a desired constant power level.

31. A heated apparel system according to claim 1 wherein the heater controller comprises at least one from the group consisting of buttons, a knob, a slider and a touch screen.

32. A heated apparel system according to claim 1 wherein the at least one article of apparel is connected to the heater controller through an intervening article of apparel.

33. A heated apparel system according to claim 32 wherein the intervening article of apparel comprises its own e-textile heater element harness which is also connected to the heater controller.

34. A heated apparel system according to claim 32 wherein the intervening article of apparel does not comprise its own e-textile heater element harness.

35. A heated apparel system according to claim 32 wherein the at least one article of apparel is mechanically and electrically connected to the intervening article of apparel by means of a connector.

36. A heated apparel system according to claim 32 wherein the intervening article of apparel comprises at least one from the group consisting of a shirt, sweater, coat, pants, underwear, socks, hat, balaclava, scarf, neck warmer, gloves, mittens, compression sleeves, insoles, chap pants and torso-less shirt.

37. A heated apparel system according to claim 32 wherein the intervening article of apparel comprises an electrical power bus for electrically connecting the heater controller to the at least one article of apparel.

38. A method for warming a portion of the body of a user, the method comprising:

providing a heated apparel system comprising:

an e-textile heater element harness;

at least one article of apparel, wherein the e-textile heater element harness is laminated or stitched onto the at least one article of apparel;

an electrical power supply; and a heater controller being connectable to the electrical power supply and the e-textile heater element harness, the heater controller comprising:

a control component configured to monitor and control the electrical power delivered to the e-textile heater element harness from the electrical power supply; and using the heater controller to control the electrical power delivered to the e-textile heater element harness so as to warm a portion of the body of the user.

39. A heated apparel system comprising:

an e-textile heater element harness;

at least one article of apparel, wherein the e-textile heater element harness is laminated or stitched onto the at least one article of apparel;

an electrical power supply, wherein the electrical power supply comprises a conformal battery; and a heater controller connected to the e-textile heater element harness and to the conformal battery, the heater controller comprising:

a control component configured to monitor and control the electrical power delivered to the e-textile heater element harness from the conformal battery.

40. A heated apparel system according to claim 39 wherein the at least one article of apparel comprises at least one from the group consisting of a belt, a garment having a pocket, harness, vest, clip, backpack, waist pack, field bag, pouch and satchel.

41. A heated apparel system of claim 39 further comprising a power bus for powering an e-textile heater element harness on a different article of apparel.

42. An article of heated apparel, the article of heated apparel comprising:

a body wearable by a user;

an e-textile heater element harness laminated to or stitched onto the body, wherein the e-textile heater element harness provides heat when connected to an electrical power supply;

a power bus formed integral with the body; and a heater controller connected to the e-textile heater element harness and to the power bus, the heater controller comprising:

a control component configured to monitor and control the electrical power delivered to the e-textile heater element harness.

43. A heated apparel system comprising:

a first article of apparel, the first article of apparel comprising:

a first body wearable by a user;

a first e-textile heater element harness laminated to or stitched onto the first body, wherein the first e-textile heater element harness provides heat when connected to an electrical power supply;

a first power bus formed integral with the first body, the first power bus being connected to the first e-textile heater element harness; and an auxiliary power bus formed integral with the first body;

a second article of apparel, the second article of apparel comprising:

a second body wearable by a user;

a second e-textile heater element harness laminated to or stitched onto the second body, wherein the second e-textile heater element harness provides heat when connected to the electrical power supply; and a second power bus formed integral with the second body, the second power bus being connected to the auxiliary power bus; and a heater controller connected to the first e-textile heater element harness and the second e-textile heater element harness, the heater controller comprising:

a control component configured to monitor and control the electrical power delivered to the first and second e-textile heater element harnesses.

* * * * *